US007677544B2

(12) United States Patent
Awano

(10) Patent No.: US 7,677,544 B2
(45) Date of Patent: Mar. 16, 2010

(54) BOOKLET-LOADING DEVICE, POST-TREATMENT DEVICE AND IMAGE-FORMING SYSTEM

(75) Inventor: Hiroaki Awano, Ebina (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 382 days.

(21) Appl. No.: 11/512,353

(22) Filed: Aug. 30, 2006

(65) Prior Publication Data

US 2007/0090582 A1 Apr. 26, 2007

(30) Foreign Application Priority Data

Oct. 25, 2005 (JP) ..... 2005-309490
Oct. 25, 2005 (JP) ..... 2005-309491

(51) Int. Cl.
*B65H 31/00* (2006.01)

(52) U.S. Cl. ..... 270/58.11; 270/37; 270/45; 270/58.07; 270/51; 270/58.08; 270/58.09

(58) Field of Classification Search ..... 270/37, 270/45, 51, 58.07, 58.08, 58.09, 58.11
See application file for complete search history.

(56) References Cited

U.S. PATENT DOCUMENTS 6,048,152 A * 4/2000 Koyama ..... 412/22
7,178,799 B2 * 2/2007 Wakabayashi et al. ... 270/39.06
2001/0019191 A1 * 9/2001 Yoshie et al. ..... 270/52.17

FOREIGN PATENT DOCUMENTS

JP 2000-153958 6/2000
JP 2000-255882 9/2000
JP 3370284 B 1/2003

OTHER PUBLICATIONS

Machine translation of Japanese Publication 2000-103567.

* cited by examiner

*Primary Examiner*—Gene Crawford
*Assistant Examiner*—Leslie A Nicholson, III
(74) *Attorney, Agent, or Firm*—Morgan, Lewis & Bockius LLP

(57) ABSTRACT

A booklet-loading device includes: a carry-out unit that conveys plural of booklets sequentially; and a transfer unit that transfers the plural of booklets sequentially conveyed from the carry-out unit, and arranges the plural of booklets in a partly overlapped state; a loaded unit that is loaded with the booklets transferred by the transfer unit; and a transfer control unit that controls a transfer amount per booklet in the transfer unit to a transfer amount depending on a quantity of booklets loaded on the loaded unit.

2 Claims, 19 Drawing Sheets

| | | | Without square fold | | | | With square fold | | | |
|---|---|---|---|---|---|---|---|---|---|---|
| | | | without title page or 80≧ x ≧ 64gsm | with title page 104≧ x >80gsm | with title page 128≧ x> 104gsm | with title page 158 ≧ x> 128gsm | without title page or 80≧ x ≧ 64gsm | with title page 104≧ x >80gsm | with title page 128≧ x> 104gsm | with title page 158 ≧ x> 128gsm |
| Paper size (feed direction) x≦A4 | Net paper thickness 80≧ x ≧ 64gsm | Net paper, up to 5 sheets | 500 | 500 | 500 | Prohibited | 150 | 150 | 150 | 200 |
| | | Net paper, 6 to 10 sheets | 600 | 500 | 500 | Prohibited | 250 | 300 | 300 | 300 |
| | | Net paper, 11 to 15 sheets | 600 | 500 | 500 | Prohibited | 400 | 400 | 400 | 400 |
| | Net paper thickness 104≧ x >80gsm | Net paper, up to 5 sheets | Prohibited | 500 | 500 | Prohibited | Prohibited | 200 | 200 | 200 |
| | | Net paper, 6 to 10 sheets | Prohibited | 500 | 500 | Prohibited | Prohibited | 350 | 350 | 350 |
| | | Net paper, 11 to 15 sheets | Prohibited | Prohibited | Prohibited | Prohibited | Prohibited | Prohibited | Prohibited | Prohibited |
| | Net paper thickness 128≧ x> 104gsm | Net paper, up to 5 sheets | Prohibited | Prohibited | Prohibited | Prohibited | Prohibited | Prohibited | 250 | 250 |
| | | Net paper, 6 to 10 sheets | Prohibited | Prohibited | Prohibited | Prohibited | Prohibited | Prohibited | 400 | 450 |
| | | Net paper, 11 to 15 sheets | Prohibited | Prohibited | Prohibited | Prohibited | Prohibited | Prohibited | Prohibited | Prohibited |
| Paper size (feed direction) A4<x<A3 | Net paper thickness 80≧ x ≧ 64gsm | Net paper, up to 5 sheets | 500 | 500 | 500 | Prohibited | 150 | 150 | 150 | 150 |
| | | Net paper, 6 to 10 sheets | 500 | 500 | 500 | Prohibited | 250 | 250 | 250 | 250 |
| | | Net paper, 11 to 15 sheets | 500 | 500 | 500 | Prohibited | 350 | 350 | 350 | 350 |
| | Net paper thickness 104≧ x >80gsm | Net paper, up to 5 sheets | Prohibited | 500 | 500 | Prohibited | Prohibited | 150 | 200 | 200 |
| | | Net paper, 6 to 10 sheets | Prohibited | 500 | 500 | Prohibited | Prohibited | 300 | 300 | 300 |
| | | Net paper, 11 to 15 sheets | Prohibited | Prohibited | Prohibited | Prohibited | Prohibited | Prohibited | Prohibited | Prohibited |
| | Net paper thickness 128≧ x> 104gsm | Net paper, up to 5 sheets | Prohibited | Prohibited | Prohibited | Prohibited | Prohibited | Prohibited | 200 | 200 |
| | | Net paper, 6 to 10 sheets | Prohibited | Prohibited | Prohibited | Prohibited | Prohibited | Prohibited | 350 | 350 |
| | | Net paper, 11 to 15 sheets | Prohibited | Prohibited | Prohibited | Prohibited | Prohibited | Prohibited | Prohibited | Prohibited |
| Paper size (feed direction) x≧A3 | Net paper thickness 80≧ x ≧ 64gsm | Net paper, up to 5 sheets | 500 | 500 | 500 | Prohibited | 100 | 150 | 150 | 150 |
| | | Net paper, 6 to 10 sheets | 500 | 500 | 500 | Prohibited | 200 | 200 | 200 | 200 |
| | | Net paper, 11 to 15 sheets | 500 | 500 | 500 | Prohibited | 300 | 300 | 300 | 300 |
| | Net paper thickness 104≧ x >80gsm | Net paper, up to 5 sheets | Prohibited | 500 | 500 | Prohibited | Prohibited | 150 | 150 | 150 |
| | | Net paper, 6 to 10 sheets | Prohibited | 500 | 500 | Prohibited | Prohibited | 250 | 250 | 250 |
| | | Net paper, 11 to 15 sheets | Prohibited | Prohibited | Prohibited | Prohibited | Prohibited | Prohibited | Prohibited | Prohibited |
| | Net paper thickness 128≧ x> 104gsm | Net paper, up to 5 sheets | Prohibited | Prohibited | Prohibited | Prohibited | Prohibited | Prohibited | 200 | 200 |
| | | Net paper, 6 to 10 sheets | Prohibited | Prohibited | Prohibited | Prohibited | Prohibited | Prohibited | 300 | 300 |
| | | Net paper, 11 to 15 sheets | Prohibited | Prohibited | Prohibited | Prohibited | Prohibited | Prohibited | Prohibited | Prohibited |

Fig. 5

Fig. 19

Loading limit booklet count

| | | | Without square fold | | | | With square fold | | | |
|---|---|---|---|---|---|---|---|---|---|---|
| | | | Without title page or 80≧ x ≧ 64gsm | With title page 104≧ x>80gsm | With title page 128≧ x> 104gsm | With title page 158 ≧ x>128gsm | Without title page or 80≧ x ≧ 64gsm | With title page 104≧ x>80gsm | With title page 128≧ x> 104gsm | With title page 158 ≧ x>128gsm |
| Paper size (feed direction) x≦A4 | Net paper thickness 80≧ x ≧ 64gsm | Net paper, up to 5 sheetes | 20 | 20 | 20 | Prohibited | 160 | 150 | 150 | 140 |
| | | Net paper, 6 to 10 sheetes | 20 | 20 | 20 | Prohibited | 90 | 90 | 90 | 80 |
| | | Net paper,11to 15 sheetes | 20 | 20 | 20 | Prohibited | 60 | 60 | 60 | 60 |
| | Net paper thickness 104≧ x>80gsm | Net paper, up to 5 sheetes | Prohibited | 20 | 20 | Prohibited | Prohibited | 120 | 120 | 120 |
| | | Net paper, 6 to 10 sheetes | Prohibited | 20 | 20 | Prohibited | Prohibited | 70 | 70 | 70 |
| | | Net paper,11to 15 sheetes | Prohibited | Prohibited | Prohibited | Prohibited | Prohibited | Prohibited | Prohibited | Prohibited |
| | Net paper thickness 128≧ x> 104gsm | Net paper, up to 5 sheetes | Prohibited | Prohibited | Prohibited | Prohibited | Prohibited | Prohibited | 100 | 100 |
| | | Net paper, 6 to 10 sheetes | Prohibited | Prohibited | Prohibited | Prohibited | Prohibited | Prohibited | 60 | 60 |
| | | Net paper,11to 15 sheetes | Prohibited | Prohibited | Prohibited | Prohibited | Prohibited | Prohibited | Prohibited | Prohibited |
| Paper size (feed direction) A4<x<A3 | Net paper thickness 80≧ x ≧ 64gsm | Net paper, up to 5 sheetes | 20 | 20 | 20 | Prohibited | 130 | 130 | 120 | 120 |
| | | Net paper, 6 to 10 sheetes | 20 | 20 | 20 | Prohibited | 80 | 70 | 70 | 70 |
| | | Net paper,11to 15 sheetes | 20 | 20 | 20 | Prohibited | 50 | 50 | 50 | 50 |
| | Net paper thickness 104≧ x>80gsm | Net paper, up to 5 sheetes | Prohibited | 20 | 20 | Prohibited | Prohibited | 100 | 100 | 100 |
| | | Net paper, 6 to 10 sheetes | Prohibited | 20 | 20 | Prohibited | Prohibited | 60 | 60 | 60 |
| | | Net paper,11to 15 sheetes | Prohibited | Prohibited | Prohibited | Prohibited | Prohibited | Prohibited | Prohibited | Prohibited |
| | Net paper thickness 128≧ x> 104gsm | Net paper, up to 5 sheetes | Prohibited | Prohibited | Prohibited | Prohibited | Prohibited | Prohibited | 90 | 80 |
| | | Net paper, 6 to 10 sheetes | Prohibited | Prohibited | Prohibited | Prohibited | Prohibited | Prohibited | 50 | 50 |
| | | Net paper,11to 15 sheetes | Prohibited | Prohibited | Prohibited | Prohibited | Prohibited | Prohibited | Prohibited | Prohibited |
| Paper size (feed direction) x≧A3 | Net paper thickness 80≧ x ≧ 64gsm | Net paper, up to 5 sheetes | 20 | 20 | 20 | Prohibited | 120 | 110 | 110 | 100 |
| | | Net paper, 6 to 10 sheetes | 20 | 20 | 20 | Prohibited | 70 | 60 | 60 | 60 |
| | | Net paper,11to 15 sheetes | 20 | 20 | 20 | Prohibited | 50 | 50 | 40 | 40 |
| | Net paper thickness 104≧ x>80gsm | Net paper, up to 5 sheetes | Prohibited | 20 | 20 | Prohibited | Prohibited | 90 | 90 | 80 |
| | | Net paper, 6 to 10 sheetes | Prohibited | 20 | 20 | Prohibited | Prohibited | 50 | 50 | 50 |
| | | Net paper,11to 15 sheetes | Prohibited | Prohibited | Prohibited | Prohibited | Prohibited | Prohibited | Prohibited | Prohibited |
| | Net paper thickness 128≧ x> 104gsm | Net paper, up to 5 sheetes | Prohibited | Prohibited | Prohibited | Prohibited | Prohibited | Prohibited | 70 | 70 |
| | | Net paper, 6 to 10 sheetes | Prohibited | Prohibited | Prohibited | Prohibited | Prohibited | Prohibited | 40 | 40 |
| | | Net paper,11to 15 sheetes | Prohibited | Prohibited | Prohibited | Prohibited | Prohibited | Prohibited | Prohibited | Prohibited |

BOOKLET-LOADING DEVICE, POST-TREATMENT DEVICE AND IMAGE-FORMING SYSTEM

BACKGROUND (1) Technical Field

The invention relates to a booklet-loading device for loading booklets, a post-treatment device, and an image-forming system.

(2) Related Art

A booklet-loading device is hitherto known, which is assembled in an image-forming system represented by a printer or a copier, for loading bound booklets. The image-forming system is demanded to be installed in a small area, and the booklet-loading device is also demanded to load a greater number of booklets in a limited space.

SUMMARY

According to an aspect of the invention, there is provided a booklet-loading device in a first aspect, including:

a carry-out unit that conveys a plural of booklets sequentially;

a transfer unit that transfers the plural of booklets sequentially conveyed from the carry-out unit, and arranges the plural of booklets in a partly overlapped state;

a loaded unit that is loaded with the booklets transferred by the transfer unit; and a transfer control unit that controls a transfer amount per booklet in the transfer unit to a transfer amount depending on a quantity of booklets loaded on the loaded unit.

BRIEF DESCRIPTION OF THE DRAWINGS

Exemplary embodiments of the present invention will be described in detail based on the following figures, wherein:

FIG. 5 is an example of a table showing the relation of thickness, number of sheets and size of paper for composing booklets, presence or absence of square folding process forming the booklets in a flat back, and reference transfer amount;

FIG. 19 is an example of table showing the relation of thickness, number of sheets and size of paper for composing booklets, presence or absence of square folding process forming the booklets in a flat back, and loading amount.

DETAILED DESCRIPTION

Figure 1:
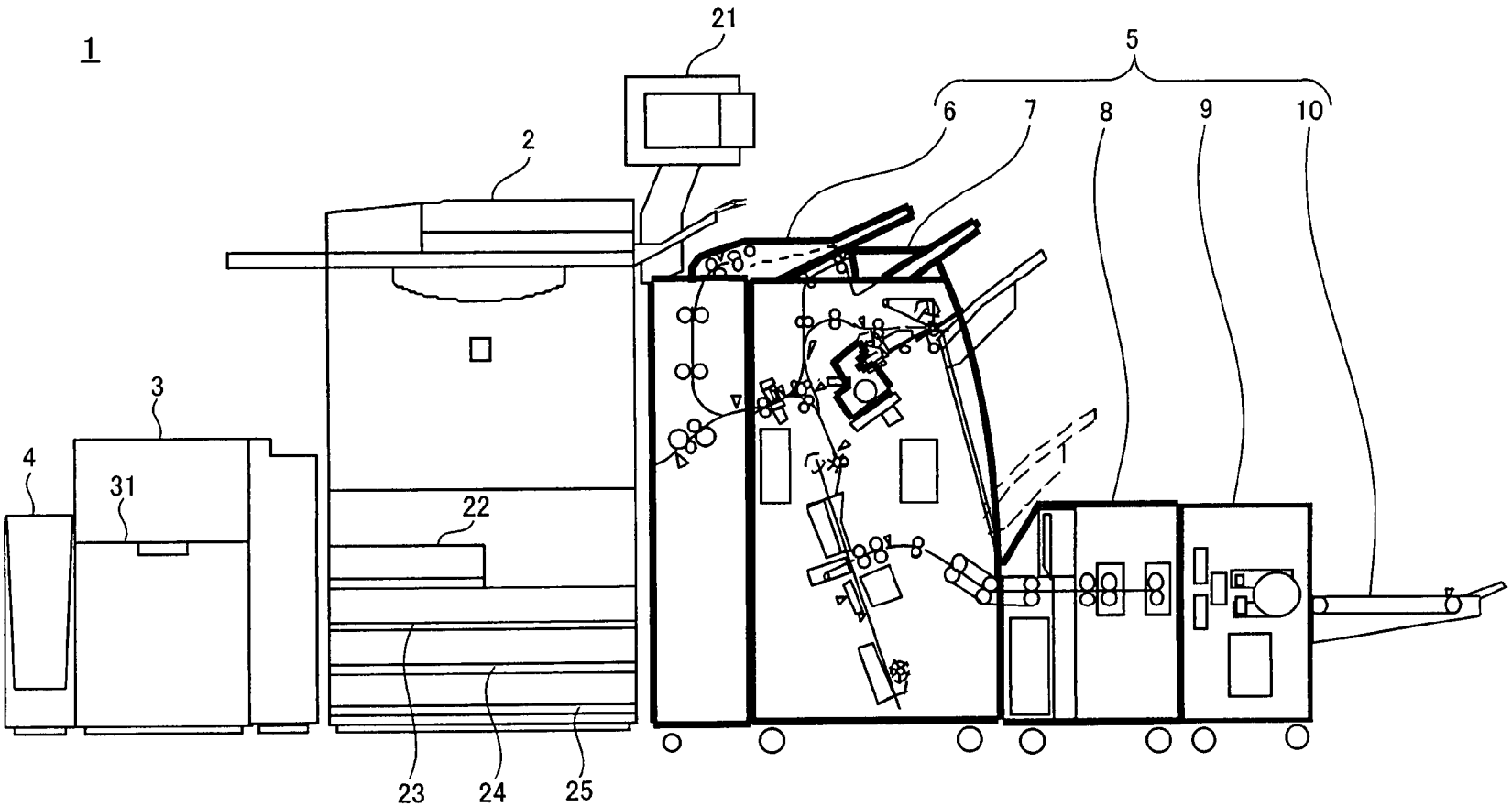
FIG. 1 is a diagram showing an image-forming system in a first exemplary embodiment of the invention.

Referring now to the drawings, exemplary embodiments of the booklet-loading device of the invention will be described below.

First Exemplary Embodiment

FIG. 1 is a block diagram showing image-forming system in a first exemplary embodiment of the invention.

An image-forming system 1 has an image-forming device 2 for forming images on paper, and a post-treatment device 5 for post-treating the paper on which images are formed by the image-forming device 2. A large capacity paper-feeding device 3 having a paper tray 31 storing a large quantity of paper is connected to the image-forming device 2, together with a print server 4 for assisting the print function of the image-forming device 2.

The image-forming device 2 includes an operation panel 21 manipulated by the user for entering information, and paper trays 22, 23, 24 and 25 for storing different types of paper. The operation panel 21 instructs attributes of paper stored in the paper trays 22 to 25 and an inserter 6, selection of paper used in image forming process, and bookbinding information of booklets.

The post-treatment device 5 includes the inserter 6 for adding and inserting a title page, a booklet finisher 7 for bundling sheets of paper, saddle stitching, folding and binding a booklet, a trimmer 8 for trimming booklets, a square-folding device 9 for performing square folding process for forming a booklet in a flat back, and a stacker 10 connected to the square-folding device 9 for stacking booklets. The booklet finisher 7, trimmer 8, and square-folding device 9 compose an examples of the bookbinding device of the invention.

The square-folding device 9 is a device for forming in a flat back, by holding a booklet from both sides so that the back may project, and pressing the projecting back to make it flat. Generally, the roller is pressed against the back of booklet and moved, and the back is formed flatly. The square-folding device 9 includes a pair of carry-out rollers 11 for conveying the booklets onto the stacker 10 as mentioned below.

Figure 2:
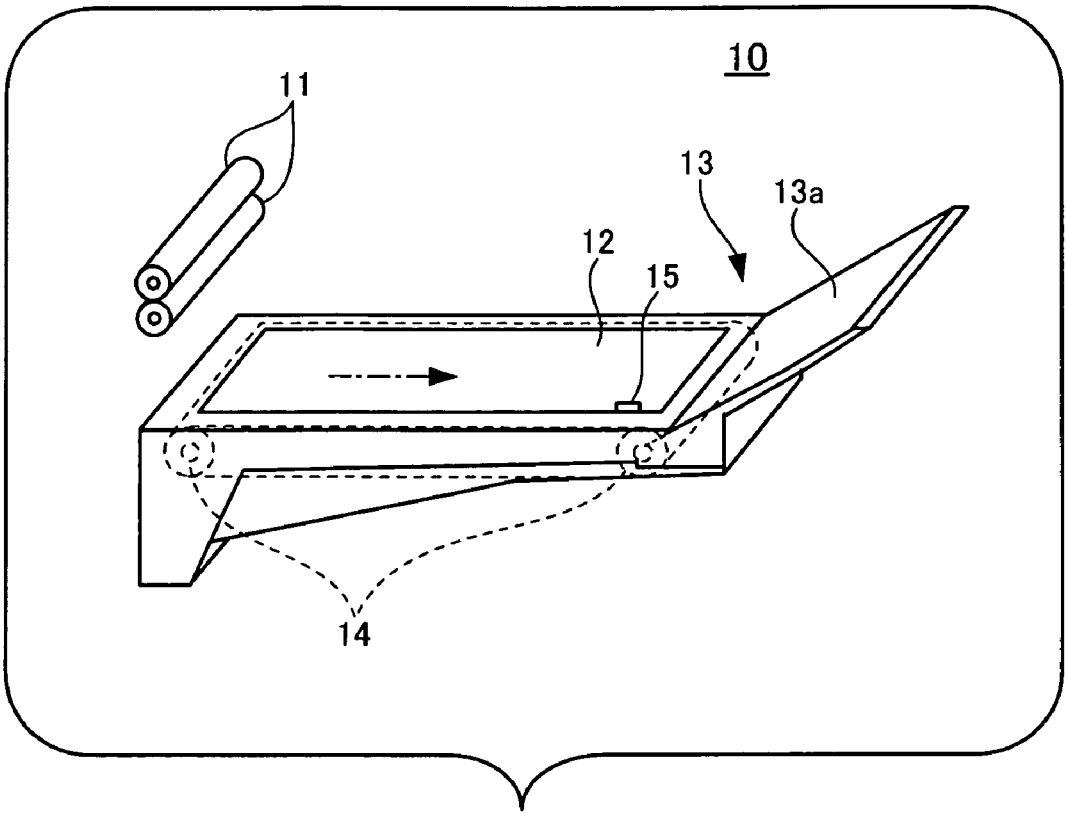
FIG. 2 is a perspective view of a stacker of the image-forming system shown in FIG. 1.

FIG. 2 is a perspective view of the stacker 10 in the image-forming system shown in FIG. 1.

FIG. 2 also shows the carry-out rollers 11 assembled in the square-folding device 9. The carry-out rollers 11 convey the booklets passing through the square-folding device 9 sequentially onto the stacker 10.

The stacker 10 has a loaded tray 13 to be loaded with booklets. The loaded tray 13 includes a rectangular frame portion disposed on the upside of the stacker 10, and a riser part 13*a* extending upward obliquely from a side of this frame. The inside of this frame portion of loaded tray 13 has a transfer belt 12 for transferring booklets. The transfer belt 12 is stretched between two drive rollers 14. When the drive rollers 14 are driven by a motor not shown, the upside of the transfer belt 12 is moved in the direction indicated by arrow in the drawing.

The booklets sequentially conveyed from the carry-out rollers 11 are loaded onto the transfer belt 12. The transfer belt 12 is moved intermittently in synchronism with the timing of carry-out of each booklet from the carry-out rollers 11. Booklets on the transfer belt 12 are transferred toward the direction of the riser part 13*a* of loaded tray 13 along with the move of the transfer belt 12.

Herein, the moving amount of the transfer belt 12 per booklet, that is, the moving amount of the transfer belt 12 from carry-out of one booklet to carry-out of next booklet is variable, as described below, depending on the thickness of booklets, size of booklets, and amount of loaded booklets, but is smaller than the length of the side along the moving direction of booklets. Accordingly, plural booklets sequentially conveyed from the carry-out roll 11 are partly overlapped, and arrayed on the transfer belt 12. The transfer belt 12 transfers the booklets in partly overlapped state. The transfer belt 12 corresponds to an example of transfer unit of the invention. By combination of the loaded tray 13 and the transfer belt 12, an example of the loaded unit of the invention is composed. The carry-out rollers 11 as a unit corresponds to an example of the carry-out unit of the invention.

The first booklet transferred by the transfer belt 12 in the arrow direction rides and is loaded on the riser part 13*a* of loaded tray 13, and is raised by the riser part 13*a*. The booklets transferred sequentially are similarly loaded on the previously transferred booklet, and is raised along the side of the previously transferred booklet. The booklets thus transferred by the transfer belt 12 are regulated in move by the loaded tray 13 and raised, and the raised booklets are sequentially loaded as being supported by the transfer belt 12.

Near the leading end of booklet transfer direction of the transfer belt 12, a sensor 15 for detecting booklets is disposed. The sensor 15 detects when the first one of the booklets arrayed on the transfer belt 12 reaches near the leading end of the transfer belt 12. As the sensor 15 detects booklets, the moving amount of the transfer belt 12 per booklet is varied.

Figure 3:
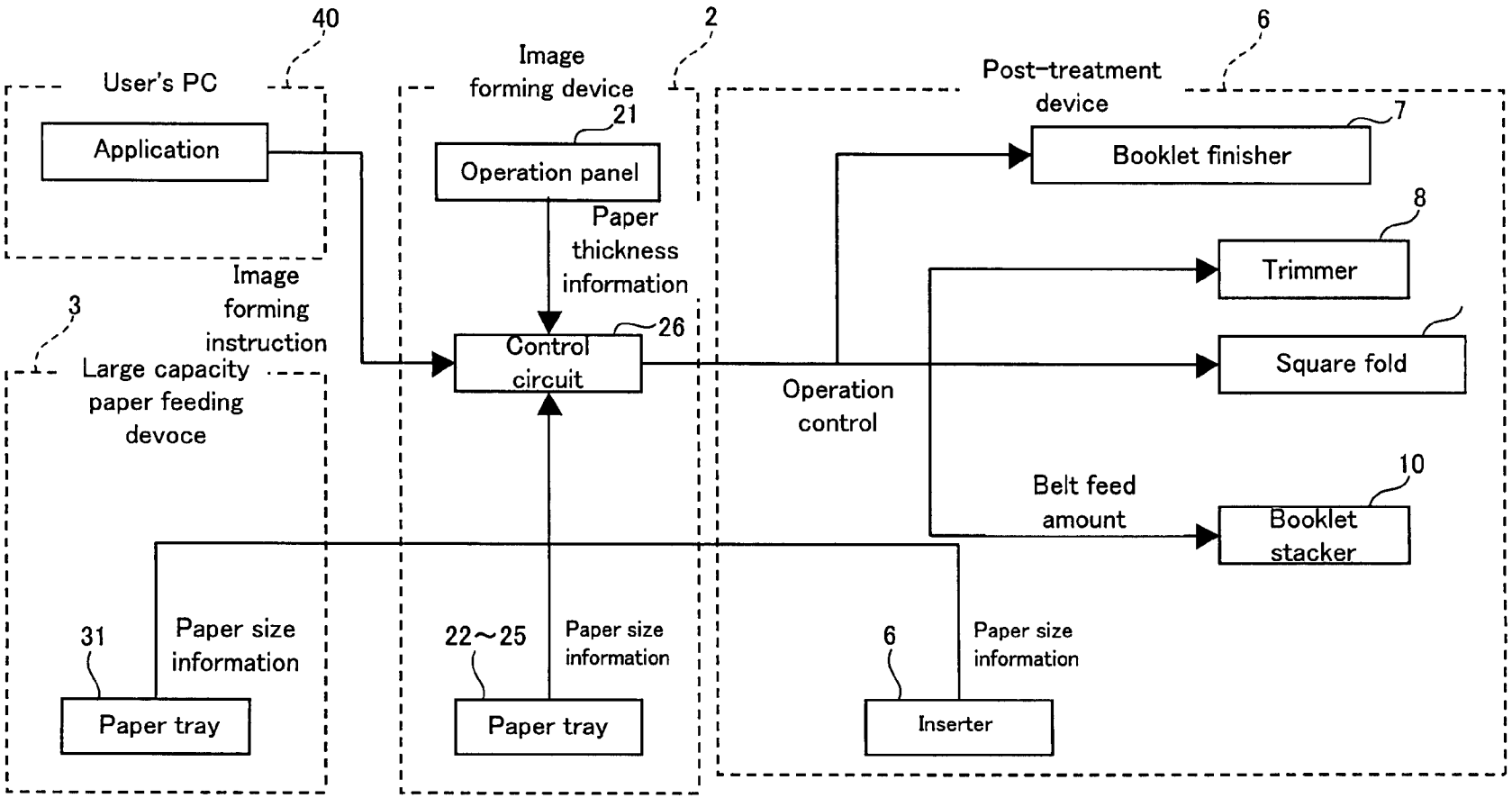
FIG. 3 is a block diagram showing an electrical configuration of the image-forming system in FIG. 1.

FIG. 3 is a block diagram showing electrical configuration of image-forming system shown in FIG. 1.

The image-forming device 2 has a control circuit 26 for controlling the entire operation of image-forming system. The control circuit 26 has, not shown in diagram, central processing unit (CPU) for controlling the entire operation of image-forming system according to a program, ROM storing program and table, RAM presenting temporary storage region to the CPU, and interface circuit for relaying signals between outside of control circuit 26 and CPU. A personal computer 40 of the user is connected externally to the image-forming device 2.

The control circuit 26 displays messages in operation panel 21 for urging input of information showing thickness, about paper of various sizes stored in the paper trays 22 to 25, paper tray 31, and inserter 6. About the paper stored in the inserter 6, a message urging input of information showing the size is displayed in operation panel 21. When the operator manipulates the operation panel 21 and enters information, the entered information is supplied from the operation panel 21 into the control circuit 26. As a result, the control circuit 26 receives information from the operator. The control circuit 26, prior to start of image forming, displays the message in the operation panel 21 for urging input of information showing the size of paper for composing booklets, number of sheets, and type of processing in bookbinding. When the operator manipulates the operation panel 21 and enters information, the entered information is supplied from the operation panel 21 into the control circuit 26. As a result, the control circuit 26 receives information from the operator about the size of paper for composing booklets, number of sheets, and type of processing in bookbinding. Herein, the type of processing in bookbinding is, for example, presence or absence of square folding process. The number of sheets and the type of processing in bookbinding correspond to an example of the bookbinding conditions of the invention.

When an instruction for image forming is sent to the control circuit 26 from the operation panel 21 or the externally connected user's personal computer 40, the control circuit 26 controls the image-forming device 2 so that the image-forming device 2 forms images on the paper. At the same time, the control circuit 26 also controls the operation of the booklet finisher 7, trimmer 8, square-folding device 9, and stacker 10. For example, the control circuit 26 controls the rotation of motor for driving a drive roller 14 of the stacker 10, and moves the transfer belt 12, and transfers booklets. The control circuit 26 also controls the time of move of the transfer belt 12 for carry-out of every booklet from the carry-out roller, and hence controls the transfer amount per booklet. The control circuit 26, stacker 10, and carry-out rollers 11 are combined to constitute an example of booklet-loading device of the invention. The control circuit 26 corresponds to an example of the transfer control unit of the invention.

Figure 4:
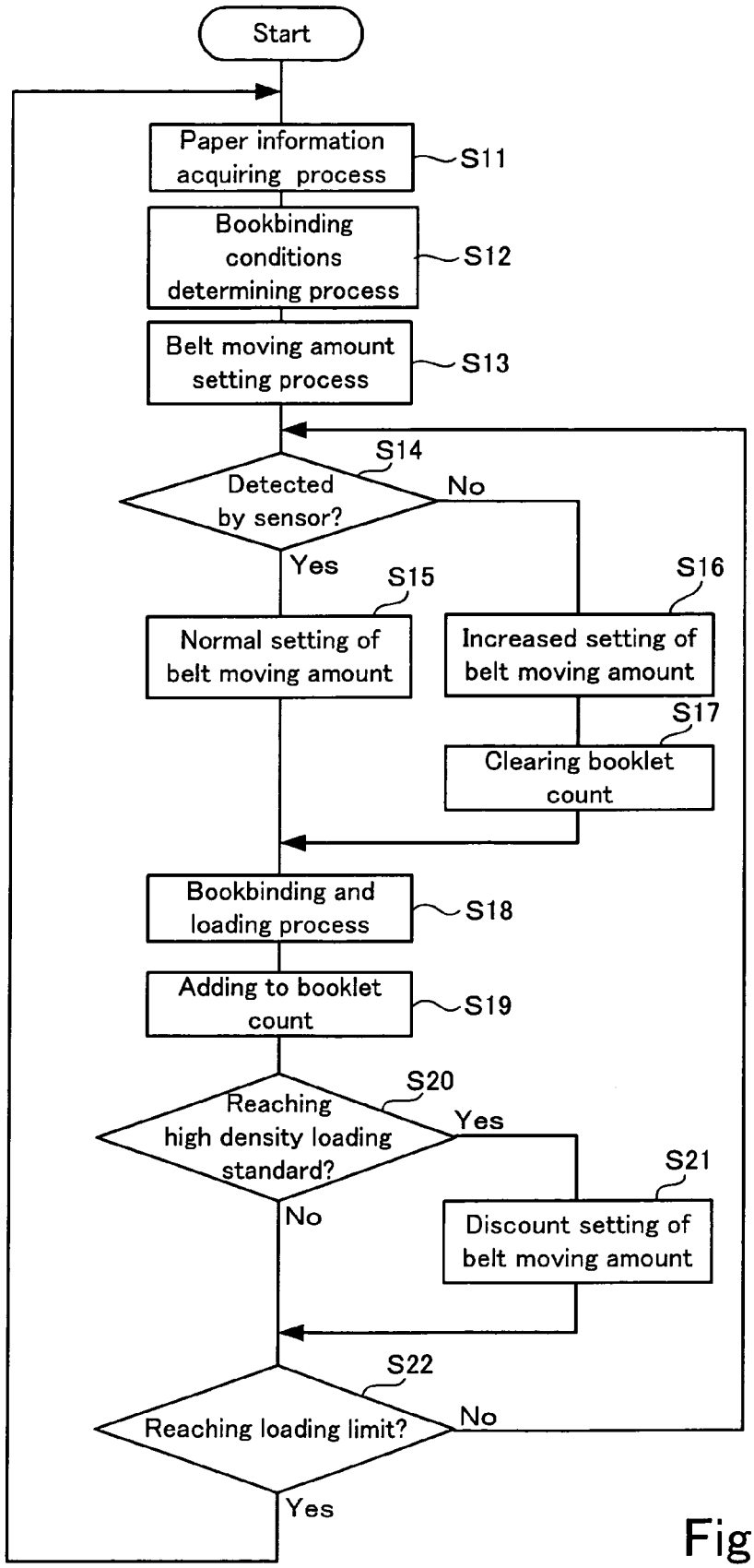
FIG. 4 is a flowchart of image forming and bookbinding process in the image-forming system.

FIG. 4 is a flowchart of image forming and bookbinding process in the image-forming system 1.

When the image forming and bookbinding process starts, first, the control circuit 26 acquires the information of paper (step S11). The control circuit 26 displays a message in the operation panel 21 for urging input of information showing the thickness, about the paper of various sizes stored in paper trays 22 to 25, paper tray 31, and inserter 6. About the paper stored in the inserter 6, a message urging input of information showing the size is displayed in operation panel 21. When the operator manipulates the operation panel 21 and enters information about thickness and size, the entered information is supplied into the control circuit 26.

In consequence, the control circuit 26 performs the bookbinding condition setting process (step S12). The control circuit 26 displays a message in the operation panel 21. This message is for urging the user to enter information about the number of sheets of paper for composing booklets, the paper trays to be used, and presence or absence of square folding process for forming booklets in a flat back. When the user manipulates the operation panel 21 and enters information about the number of sheets, the paper trays, and presence or absence of square folding process, the entered information is supplied into the control circuit 26. As a result, the control circuit 26 receives information from the user about thickness, number of sheets, and size of paper for composing booklets, and presence or absence of square folding process for forming booklets in a flat back. From the selected information of paper size, the tray for storing the paper of corresponding size is selected.

The control circuit 26 performs the process which determines the moving amount of the transfer belt 12 (step S13). Specifically, the reference moving amount is determined as the standard of moving amount of the transfer belt 12. Booklets are transferred by the transfer belt 12. Therefore, when the reference moving amount is determined, the standard amount of moving amount per booklet by the transfer belt 12 is determined. The reference moving amount is expressed as the moving time of the transfer belt 12 every time a booklet is conveyed from the carry-out rollers 11. Herein, by determining the reference moving amount depending on the thickness of booklets, as mentioned below, the array state of booklets loaded on the stacker 10 can be kept in neat state. In the image-forming system 1 of the exemplary embodiment, about the information obtained at steps S11 and S12, that is, the paper for composing the booklets, the reference moving amount is determined depending on the thickness of booklets, on the basis of information showing the thickness, number of sheets and size, and information showing presence or absence of square folding process forming booklets in a flat back. Therefore, a unit that directly measures the thickness of booklets is not provided.

Herein, thickness of booklets is not thickness of loaded booklets when a load is applied from the top, but refers to the thickness of booklets conveyed from the carry-out rollers 11, being free from load.

Figure 14:
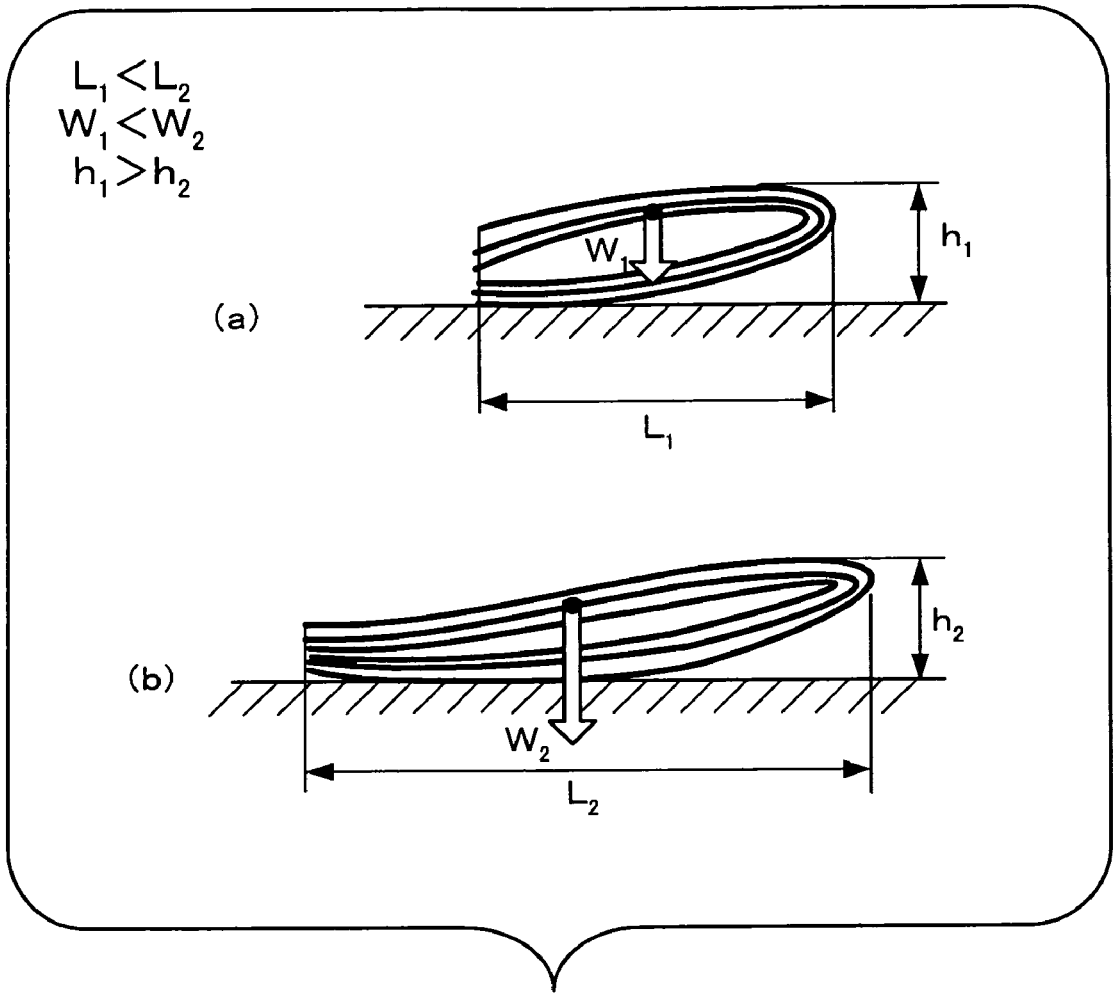
FIG. 14 is a diagram showing booklets of different sizes and different heights.

Thickness of paper for composing booklet is, if the number of sheets is the same, smaller when the booklet size is larger. As shown in FIG. 14, by the moment of own weight of booklet, a force acts so as not to open the pages.

FIG. 5 is an example of table showing the relation of thickness, number of sheets, and size of paper for composing booklets, presence or absence of square folding process forming booklets in a flat back, and reference moving amount. This table is stored in the ROM of control circuit 26. In three rows from the left end of the table, paper size, thickness of sheets except for title page, and number of sheets are expressed sequentially from the left. In the top two lines of the table, presence or absence of square folding process, and thickness of title page are expressed from the top. According to these conditions, the table expresses the reference moving amount corresponding to the thickness of booklets as the moving time of the transfer belt 12. The unit of moving time is mSec. Herein, for example, in the case of paper size of A4, paper thickness of 80 g/m$^2$, number of sheets of 6 without title page, and absence of square folding process, the reference moving amount is 600 mSec, and with presence of square folding process, the reference moving amount is 250 mSec. Thus, since the reference moving amount is set depending on the thickness of booklets based on conditions, including paper thickness, number of sheets, size, and presence or absence of square folding process for forming booklets in a flat back, the array state of booklets loaded on the stacker 10 is kept neatly. In addition, "Prohibited" item in the table means loading of booklets in the corresponding conditions of the items is prohibited because booklets cannot be loaded properly due to failure in folding by the booklet finisher 7 or other reasons. As mentioned below, the control circuit 26 controls so that the conditions in the corresponding of prohibited items may not be selected by mistake by the user.

Back to FIG. 4, explanation continues.

At step S13, the control circuit 26 performs the belt moving amount setting process. The control circuit 26 determines the corresponding reference moving about, about the paper for composing booklets, by registering the information about thickness, number of sheets, and the information showing presence or absence of square folding process for forming booklets in a flat back, in the table shown in FIG. 5. At step S12, the control circuit 26 preliminarily reads out the table shown in FIG. 5. If the user enters information of prohibited condition at step S12, the control unit 26 shows a message in the operation panel 21 to urge input of information in other condition. At step S13, the control circuit 26 also sets the loading limit of booklets. The loading limit is determined by using other table specifying the relation of information about thickness, number of sheets about the paper for composing booklets, and information showing presence or absence of square folding process for forming booklets in a flat back. When the number of booklets specified by the user is smaller than the determined loading limit, the loading limit is used as the number of booklets specified by the user.

The control circuit 26 judges if the sensor 15 of the stacker 10 has detected booklets or not (step S14). If the sensor 15 has not detected booklets (No at step S14), it means that the booklets have not reached the leading end in transfer direction on the transfer belt 12 yet, or that the booklets, once reaching up to the leading end, have been removed by the user. In this case, the control circuit 26 sets the transfer amount per booklet on the transfer belt 12 by increasing by a predetermined rate from the reference moving amount. By setting the transfer amount per booklet by increasing by a predetermined rate, the booklet is transferred to the leading end position of the transfer belt 12 to be easily visible by the user in a short time. Successively, the booklet count is cleared (step S17). The booklet count expresses the number of booklets loaded in the stacker 10, but since the count is cleared while it is judged that the sensor 15 is not detecting booklets, to be precise, it shows the number of booklets loaded after detection of booklets by the sensor 15. Afterwards, the process advances to step S18.

On the other hand, at step S14, if it is judged that the sensor 15 has detected booklets (Yes at step S14), the booklets on the transfer belt 12 have reached up to the leading end in transfer direction. In this case, the control circuit 26 sets the transfer amount per booklet in the transfer belt 12 as reference transfer amount (step S15). The transfer amount per booklet is not increased regardless of reference transfer amount, and the interval of booklets arrayed on the transfer belt 12 is narrowed. Hence, the loading amount of booklets is increased.

The control circuit 26 executes the bookbinding and loading process at step S18. The control circuit 26, on the basis of the information obtained at steps S11 and S12, controls the operation of parts of the image-forming device 2, booklet finisher 7, trimmer 8, and square-folding device 9, and performs image forming and bookbinding of paper for one booklet. As a result, the booklet finisher 7, trimmer 8, and square-folding device 9 performs bookbinding according to the bookbinding conditions specified at step S12. The control circuit 26 moves the transfer belt 12 of the stacker 10 by the time determined as the transfer amount, at the timing of conveying the booklets to the carry-out rollers 11 of the square-folding device 9. As a result, the booklets conveyed from the carry-out rollers 11 are conveyed by the transfer belt 12.

The control circuit 26 adds 1 to the booklet count (step S19), and this booklet count is the standard for starting loading of booklets at high density. It is judged whether reaching the high density loading standard or not (step S20). When the booklet count is judged to have reached the predetermined high density loading standard (Yes at step S20), the control circuit 26 sets the transfer amount per booklet on the transfer belt 12 by subtracting it from the reference transfer amount (step S21). Since the transfer amount is set as being subtracted from the reference transfer amount, the interval of booklets arrayed on the transfer belt 12 is further narrowed, and the loading amount of booklets is increased.

Next, the control circuit 26 judges whether the booklet count has reached the loading limit or not (step S22). If not reaching the loading limit (No at step S22), the control circuit 26 repeats the process from step S14. As a result, bookbinding and loading process of next booklets continues. When reaching the loading limit (Yes at step S22), the control circuit 26 returns to step S11. Herewith, the bookbinding and loading process is stopped until the user gives a new instruction by manipulating the operation panel 21.

Figure 6:
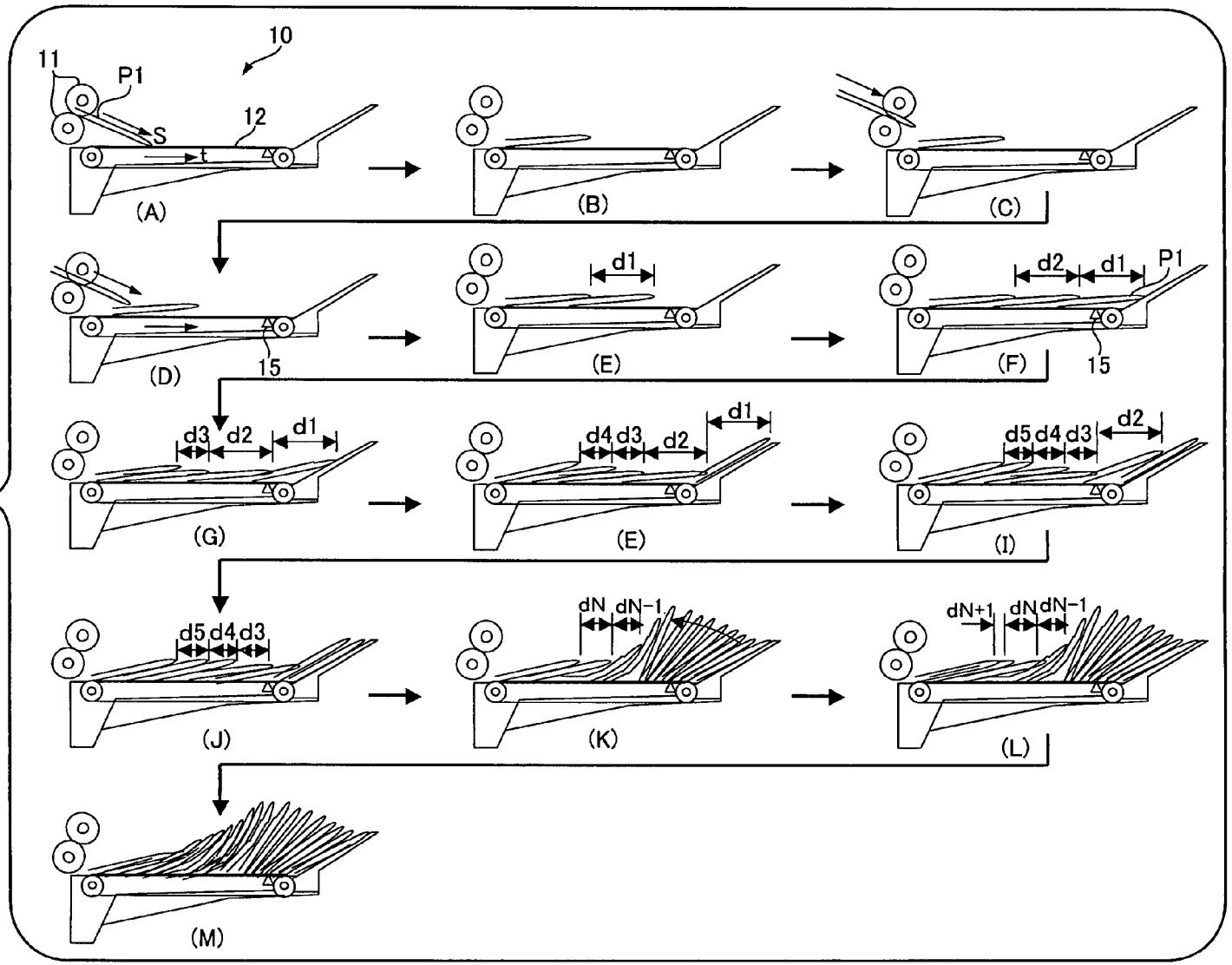
FIG. 6 is a diagram showing booklets being stacked up on the stacker.

FIG. 6 is a diagram showing loading of booklets on the stacker 10.

Specifically, FIG. 6 shows sequential steps of loading of booklets on the stacker 10, from first state (A) to thirteenth state (M). As shown in first state (A), booklet P1 is conveyed from the carry-out rollers 11 onto the transfer belt 12 in direction of arrow "s" with the back of booklet forward. The transfer belt 12 starts moving in arrow "t" in synchronism with the timing of the back of booklet P1 touching the transfer belt 12. The transfer belt 12 stops once in second state (B) after continue moving by the time set as transfer amount per booklet. From start till end of move of the transfer belt 12, booklet P1 is transferred. In the third state (C), the next booklet is conveyed through the carry-out rollers 11. In fourth state (D) and fifth state (E), the transfer belt 12 moves intermittently in synchronism with the transfer of booklet from the carry-out rollers 11.

Herein, if the booklet on the transfer belt 12 does not reach the leading end in transfer direction, and booklet is not detected by sensor 15 yet, transfer amount per booklet is set larger than the reference transfer amount (see step S16 in FIG. 4). Therefore, every time one booklet is conveyed form the carry-out rollers 11, the moving distances d1 and d2 of booklet on the transfer belt 12 are longer than the moving distance of booklet after reaching the leading end in transfer direction. Accordingly, the booklet is transferred in a short time to the leading end position of the transfer belt 12 so as to be easily recognized by the user. The stacker 10, as shown in FIG. 1, is disposed at a low position at the end of the post-treatment device 5, and the newly loaded booklet is hardly visible from the user. In such a case, the booklet is transferred to a visible position in a short time as shown in sixth state (F), and the user easily recognizes when loading of booklets is started.

When the booklet on the transfer belt 12 reaches up to the leading end in transfer direction, and the booklet is detected by the sensor 15, the transfer amount per booklet is set to the reference transfer amount and is hence decreased (see step S15 in FIG. 4). As a result, the intervals d3, d4, d5 of booklets arrayed on the transfer belt 12 are narrowed. As the interval of booklets is narrowed, the loading amount increases as shown in seventh state (G) to tenth state (J). In eleventh state (K) in FIG. 6, N+1 booklets are loaded on the stacker 10. When the booklet count showing the number of booklets loaded after the sensor 15 detects the first booklet reaches a predetermined high density loading standard (see step S20 in FIG. 5), the control circuit 26 sets the transfer amount per booklet on the transfer belt 12 by subtracting from the reference transfer amount (see step S21 in FIG. 5). Since the transfer amount is set as being subtracted from the reference transfer amount, afterwards, as shown in twelfth state (L), interval dN+1 of booklets arrayed on the transfer belt 12 is further narrowed. Herein, the loading amount of booklets is given priority over the booklet array state. That is, as shown in thirteenth state (M), although the booklet array is likely to collapse, loading of booklets further continues.

Thus, the transfer amount per booklet on the transfer belt 12 is controlled in three stages depending on the loaded amount of booklets. Until booklets are detected by the sensor 15, booklets are transferred to visible position for the user in a short time, and after booklets are detected by the sensor 15, the transfer amount decreases and the loading amount increases. After the booklet count reaches the high density loading standard, the transfer amount further decreases and priority is given to increase of loading amount. In this manner, depending on the loaded amount of booklets, the transfer amount per booklet on the transfer belt 12 is controlled, and the user's visibility of booklet is enhanced, and the loading amount of booklets increase.

Next, in the case of booklets of different thicknesses loaded on the stacker 10 of the exemplary embodiment will be described.

Figure 7:
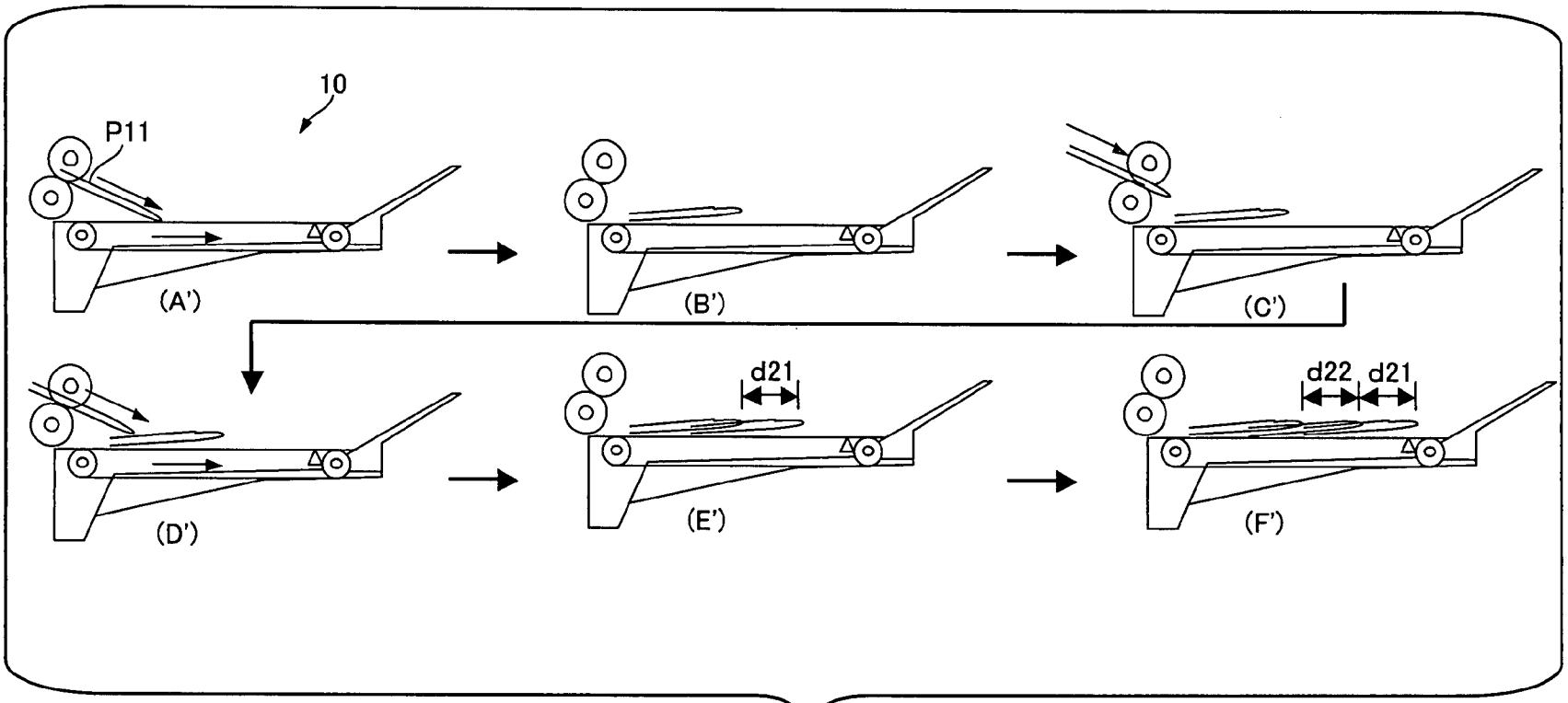
FIG. 7 is a diagram showing booklets of different thicknesses being stacked up on the stacker.

FIG. 7 shows booklets of different thicknesses are loaded on the stacker 10.

Specifically, in FIG. 7, modes of loading of booklets on the stacker 10 are shown from twenty-first state (A') to twenty-sixth state (F'). In FIG. 7, twenty-first state (A') to twenty-sixth state (F') correspond to first state (A) to sixth state (F) in FIG. 6, respectively. However, booklets in FIG. 7 are supposed to be smaller in thickness than booklets in FIG. 6.

Herein, when thickness of booklets to be transferred is smaller, the transfer amount per booklet on the transfer belt 12 is also smaller. For example, when the booklets in FIG. 6 are A4 in paper size, 80 g/m$^2$ in paper thickness, 6 in the number of sheets without title page, and without square folding process, according to the table in FIG. 5, the reference moving amount is set at 600 mSec. On the other hand, when the booklets in FIG. 7 are in the same conditions except that the number of sheets is 5, the reference moving amount is set at 500 mSec. As a result, the transfer amount per booklet on the transfer belt 12 indicated as distances d21, d22 between booklets in FIG. 7 is smaller than distances d1, d2 of booklets shown in FIG. 6.

Thus, in the stacker 10, since the transfer amount per booklet is adjusted properly depending on the thickness of booklets, the array state of booklets is kept neatly. The array state of loaded booklet varies with the combination of thickness of booklets and transfer amount per booklet as explained below.

Figure 8:
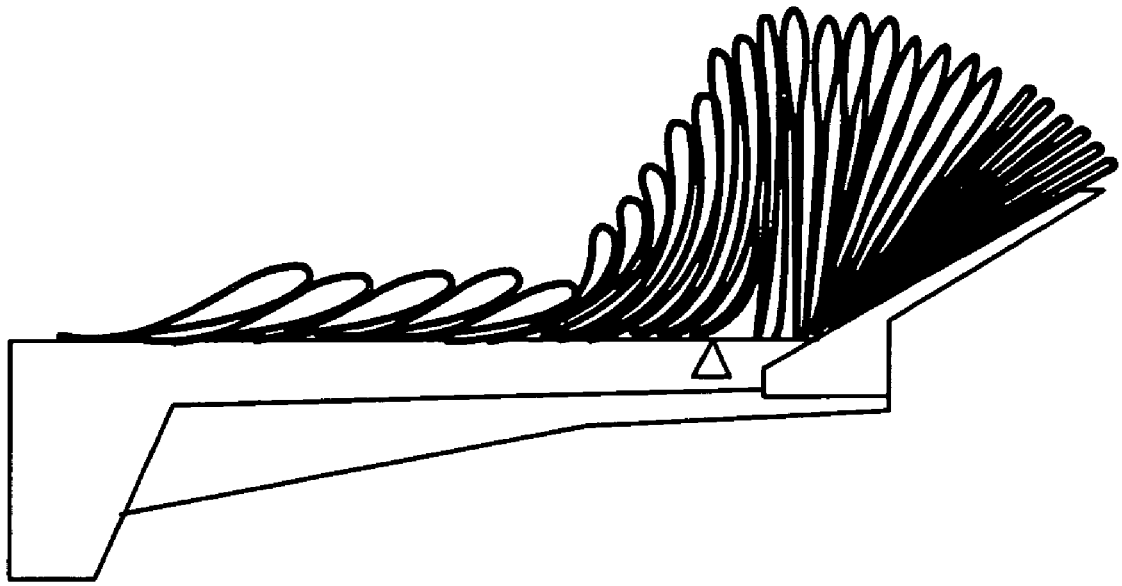
FIG. 8 is a diagram showing loading of booklets without square folding process on the stacker of the exemplary embodiment, as an example of thick booklets.
Figure 9:
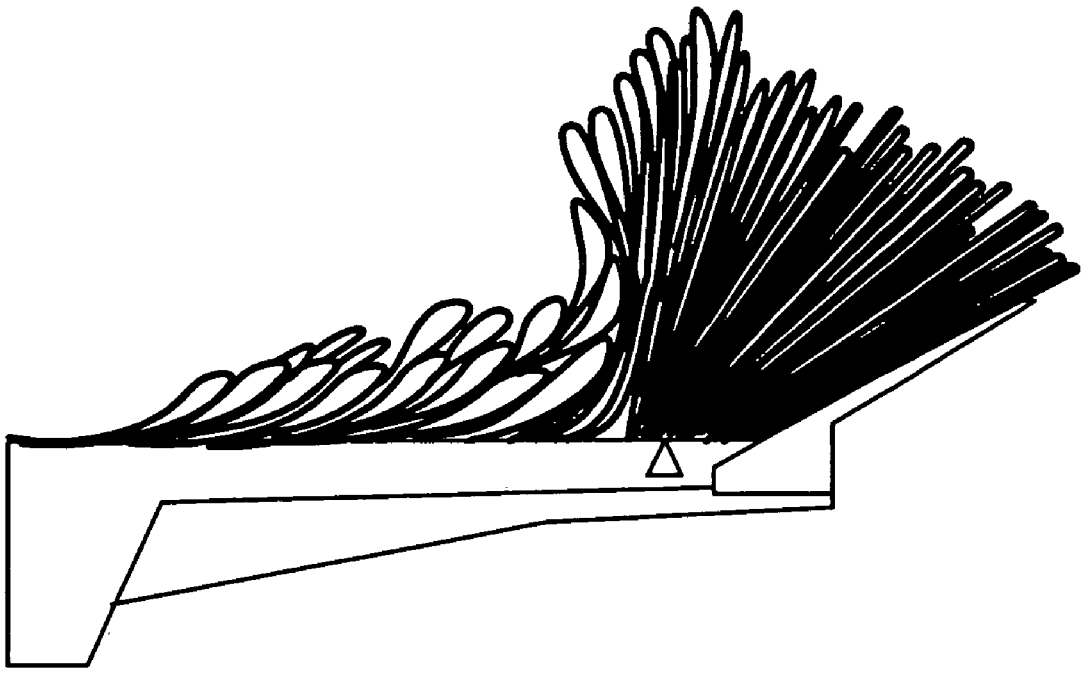
FIG. 9 is a comparative example of FIG. 8.

FIG. 8 is an example of thick booklets, showing booklets without square folding process loaded on the stacker 10 of the exemplary embodiment. FIG. 9 is a comparative example of FIG. 8, showing same booklets as in FIG. 8, loaded on the stacker, by stopping the control of transfer amount per booklet depending on the thickness of booklets and forcing relatively small.

In the case of thick booklets, as shown in FIG. 9, by reducing the transfer amount per booklet, the force of suppressing the loaded booklets is increased, and the loading amount can be increased to a certain extent. However, the array is extremely disturbed. When the booklet array is disturbed, the user takes much time to pick up and array booklets neatly. On the other hand, as shown in FIG. 8, when the transfer amount per booklet is controlled largely depending on the thickness of booklets, the array state is maintained favorably.

Figure 10:
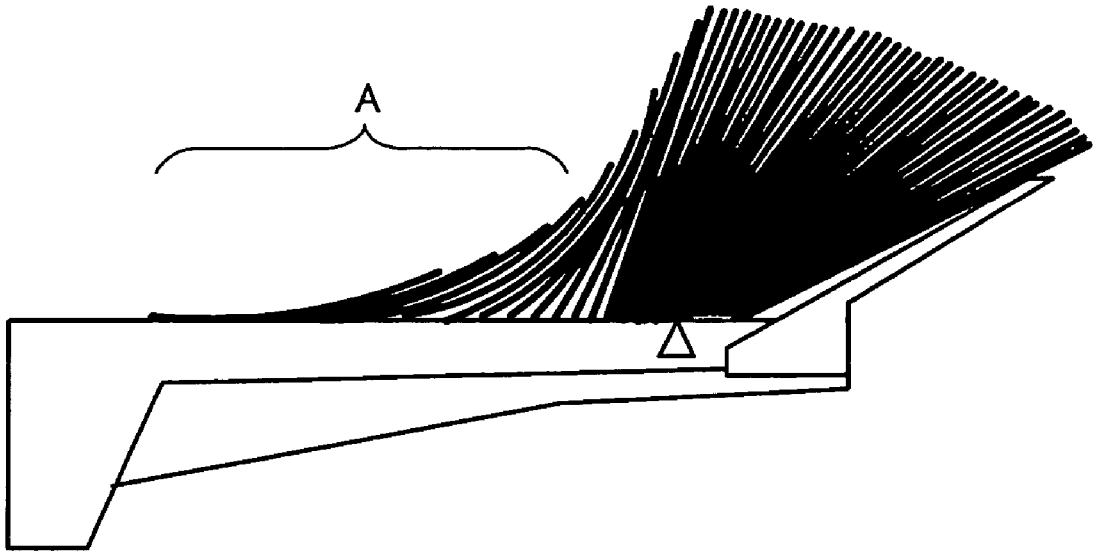
FIG. 10 is a diagram showing loading of booklets with square folding process on the stacker of the exemplary embodiment, as an example of thin booklets.
Figure 11:
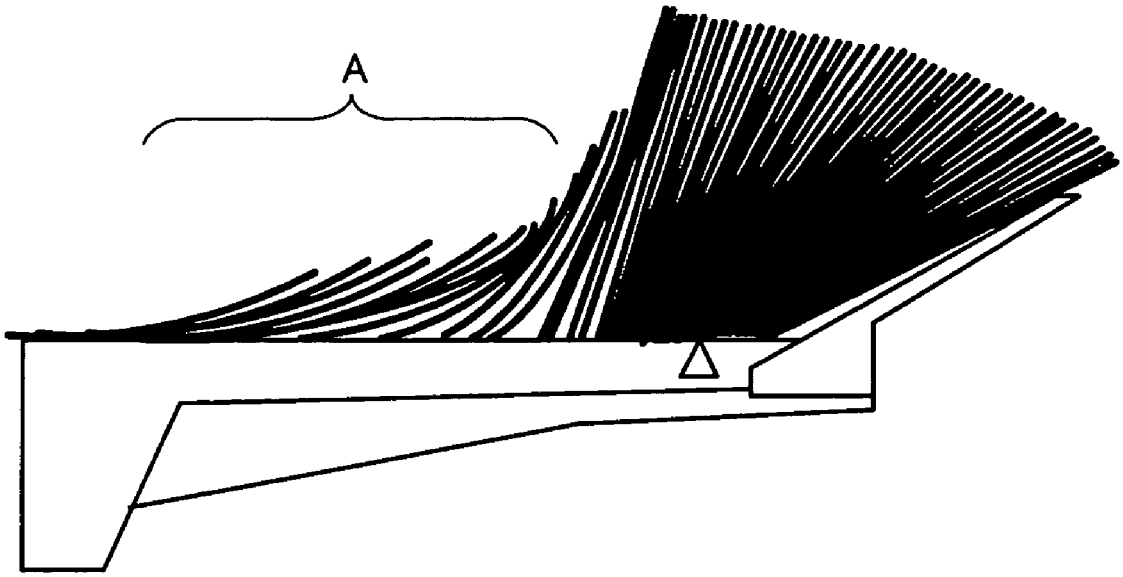
FIG. 11 is a comparative example of FIG. 10.

FIG. 10 is an example of thin booklets, showing square folded booklets loaded on the stacker 10 of the exemplary embodiment. FIG. 11 is a comparative example of FIG. 10, showing same booklets as in FIG. 10, loaded on the stacker, without controlling transfer amount per booklet depending on the thickness of booklets and forcing relatively large.

In the case of thin booklets, as shown in FIG. 10, by controlling small the transfer amount per booklet depending on the thickness of booklets, the force of suppressing the loaded booklets is increased, and the raised booklets hardly tilt to the opposite direction of loaded tray, and the loading amount can be increased. Since the booklets are small in thickness, the array of booklets is hardly disturbed. Besides, the booklets not completely raised (range A in FIG. 10) can be also arrayed in uniform intervals. On the other hand, as shown in FIG. 11, when the transfer amount per booklet is increased, the booklets not completely raised (range A in FIG. 11) may not be arrayed in uniform intervals, and the array is disturbed.

According to the stacker 10 of the exemplary embodiment, when booklets are large in thickness, transfer amount per booklet is set large, and the state of array is maintained neatly, and the convenience for the user is improved. On the other hand, when booklets are small in thickness, transfer amount per booklet is set small, and loading of booklets is increased while the state of array is maintained neatly.

In the exemplary embodiment, the control circuit 26 is assembled in the image-forming device 2, but not limited to this case, for example, the control circuit may be mounted on the stacker.

In the exemplary embodiment, the carry-out rollers 11 are assembled in the square-folding device 9, but, for example, the carry-out roller may be assembled in the stacker.

In the exemplary embodiment, the stacker 10 has the transfer belt 12 and the loaded tray for regulating the move of booklets, but the transfer unit of the invention is not limited to this configuration. For example, the loaded unit of the invention has a tray formed integrally with the transfer unit, and the tray moves, and thereby the booklets are transferred and loaded.

In the exemplary embodiment, about the paper for composing booklets, information showing the thickness, number of sheet and size, and information showing presence or absence of square folding process are obtained, and thickness of booklets is determined on the basis of obtained information, but the invention is not limited to this example, and thickness of booklets may be measured by using a thickness sensor or the like.

In the exemplary embodiment, the transfer belt 12 is moved intermittently in synchronism with transfer of booklets, but the invention is not limited to this example alone, and it is enough when the moving distance is controlled every time one booklet is conveyed from the carry-out unit, For example, the transfer belt 12 may be also moved continuously.

According to the booklet-loading device in the first aspect of the invention, depending on the amount of booklets loaded on the loaded unit, the transfer amount per booklet in the transfer unit is controlled. Therefore, for example, when the amount of loaded booklets is small, the transfer amount per booklet is increased, or when the amount of loaded booklets is large, the transfer amount per booklet is decreased. By such control, when the amount of loaded booklets is small, booklets are transferred quickly to a position easily recognized by the user, and when the amount of loaded booklets is large, the interval of loaded booklets is narrowed, and the loading amount is increased. It hence realizes the booklet-loading device high in visibility of booklets for the user and large in loading amount.

Second Exemplary Embodiment

A second exemplary embodiment of the invention will be described below.

Figure 12:
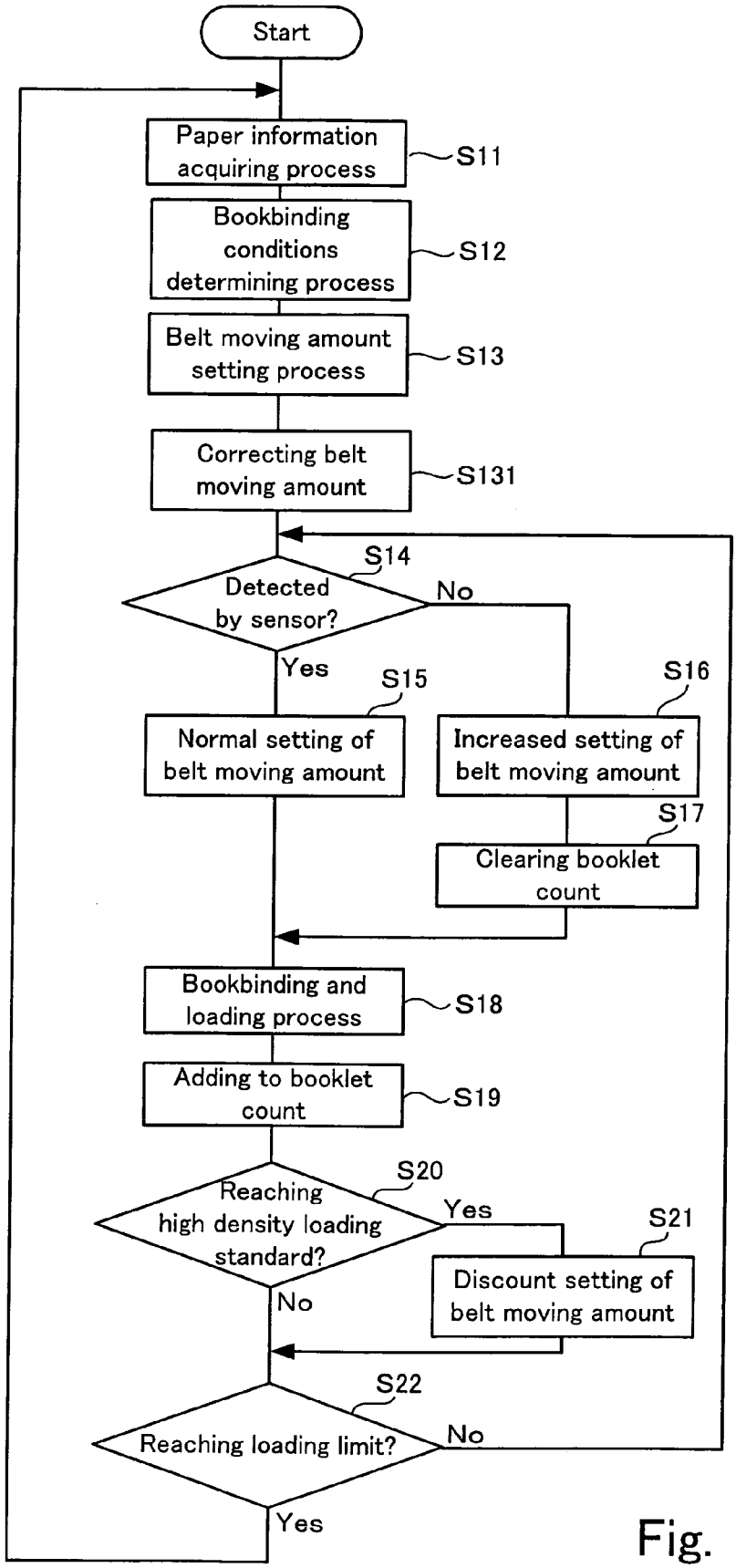
FIG. 12 is a flowchart of image forming and bookbinding process in a second exemplary embodiment of the invention.

FIG. 12 is a flowchart of image forming and bookbinding process in the second exemplary embodiment of the invention.

The second exemplary embodiment of the invention is similar to the image forming and bookbinding process in the first exemplary embodiment shown in FIG. 4, except that the step of setting the belt moving amount is followed by belt moving amount correcting process (step S131). Other process in the second exemplary embodiment is same as in the first exemplary embodiment, and same reference numerals are given and duplicate explanation is omitted. Other components of second exemplary embodiment are same as in the first exemplary embodiment, and explanation and illustration are omitted.

In this exemplary embodiment, the control circuit 26 corrects the reference transfer amount determined at belt moving amount setting process of belt moving amount correcting process (step S131) depending on the size of booklets. As a result, the control circuit 26 controls the transfer amount per booklet on the transfer belt 12 to a transfer amount depending on the size of booklets. By the control circuit 26, stacker 10, and carry-out rollers 11 of the exemplary embodiment, a third booklet-loading device of the invention is composed. The control circuit 26 in the exemplary embodiment corresponds to an example of transfer control unit provided in the third booklet-loading device of the invention.

At step S131, the control unit 26 increases or decreases the reference transfer amount depending on the difference between the size of booklets to be loaded, and the predetermined standard size of booklets. For example, when a sheet of A3 size is folded, and the size of bound booklets is determined as the standard size of booklets. When the size of loaded booklets is smaller than the standard booklet size, the transfer amount corresponding to the difference of two booklet sizes is reduced from the reference transfer amount determined in the belt moving amount setting process at step S131. By this process, as the booklet size becomes smaller, the reference transfer amount is also smaller.

The user of the image-forming system 1 may instruct a new bookbinding and loading command for loading booklets of different type successively without taking out the booklets loaded on the stacker 10. In such a case, for example, when booklets of larger size are newly conveyed while booklets of smaller size are arrayed on the transfer belt 12, the existing booklets of smaller size are concealed by the succeeding booklets of larger size and may not be visible. According to the stacker 10 of the second exemplary embodiment, since the reference transfer amount is adjusted by the control circuit 26 depending on the size of booklets to be loaded, the transfer amount per booklet is adjusted on the transfer belt 12. For example, when booklets of larger size are newly conveyed while booklets of smaller size are already arrayed on the transfer belt 12, the transfer amount per booklet is increased in a range not to conceal the existing booklets.

Now, how booklets of different sizes are loaded on the stacker 10 in the second exemplary embodiment will be explained.

Figure 13:
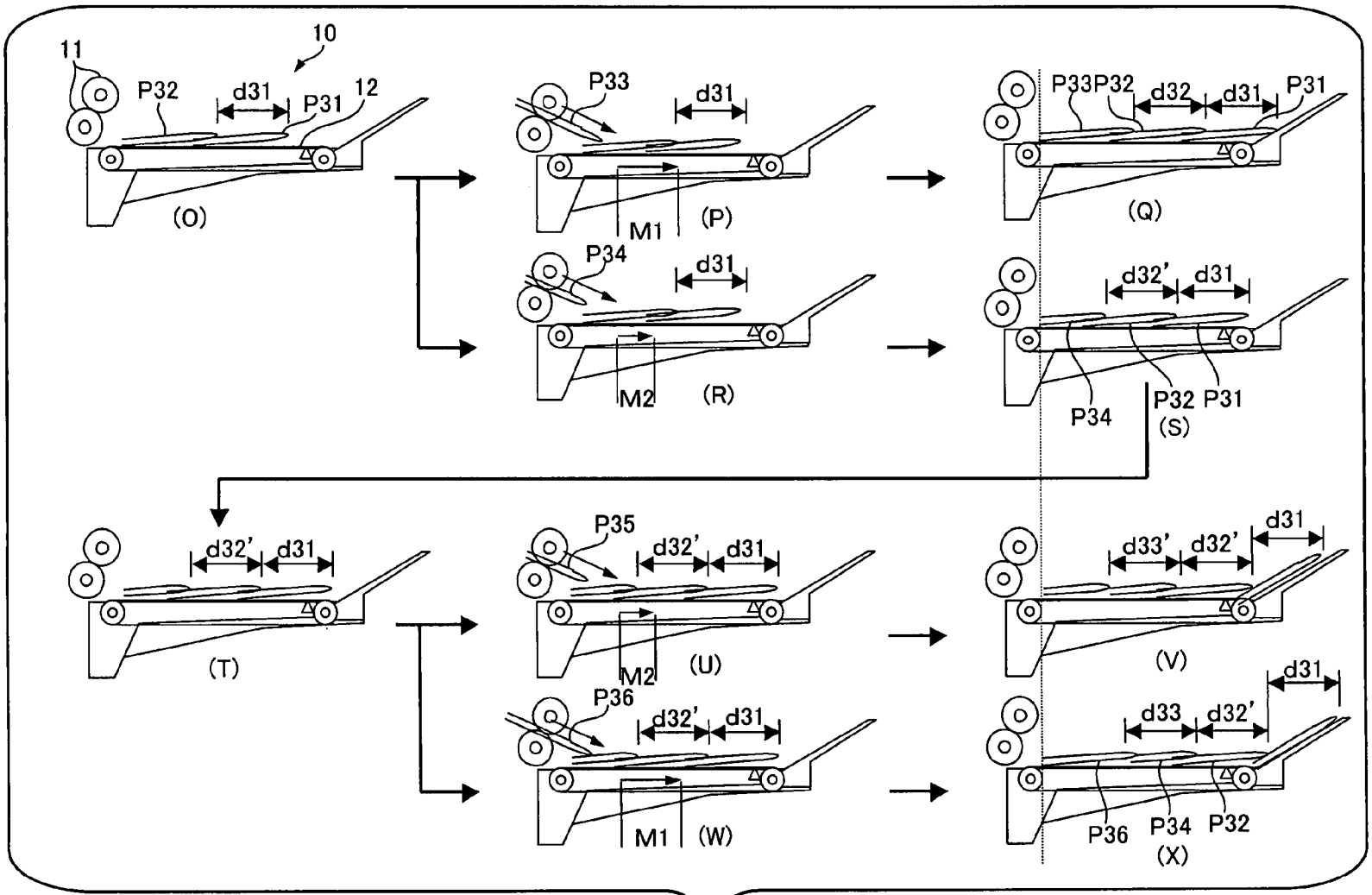
FIG. 13 is a diagram showing loading of booklets of different sizes on a stacker in the second exemplary embodiment.

FIG. 13 is a diagram showing how booklets of different sizes are loaded on the stacker 10.

FIG. 13 shows how booklets are loaded on the stacker 10 from thirty-first state (O) to fortieth state (X) corresponding to combination of different sizes. In thirty-first state (O), thirty-second state (P) and thirty-third state (Q) in FIG. 13, loading of booklets of same size is shown as loading pattern 1. In thirty-first state (O), thirty-fourth state (R), thirty-fifth state (S), thirty-sixth state (T), thirty-seventh state (U) and thirty-eighth state (V) in FIG. 13, loading of two booklets of same size followed by loading of two booklets of relatively smaller size is shown as loading pattern 2. In thirty-first state (O), thirty-fourth state (R), thirty-fifth state (S), thirty-sixth state (T), thirty-ninth state (W) and fortieth state (X) in FIG. 13, loading of two booklets of same size followed by loading of one booklet of relatively smaller size and further followed by loading of one booklet of same size as first and second booklets is shown as loading pattern 3.

Loading pattern 1 will be described. In thirty-first state (O), relatively large booklets P31 and P32 are partly overlapped and transferred on the transfer belt 12. Here, the user instructs a new bookbinding and loading command, and in thirty-second state (P), booklet P33 of same size as booklets P31, P32 is conveyed from the carry-out rollers 11. At this time, transfer amount M1 per booklet on the transfer belt 12 is same as the transfer amount of carry-out of early booklets P31, P32. Therefore, in thirty-third state (Q), having booklet P33 put on the transfer belt 12, interval d32 between side of transfer direction of booklet P32 and side of transfer direction of booklet P33 (hereinafter called interval d32 between booklet P32 and booklet P33) is equal to interval d31 between booklet P31 and booklet P32.

Loading pattern 2 will be described. In loading pattern 2, in thirty-fourth state (R) after thirty-first state (O), booklet P34 of smaller size than booklets P31, P32 is conveyed from the carry-out rollers 11. At this time, transfer amount M2 per booklet on the transfer belt 12 is corrected to be smaller than transfer amount M1 of carry-out of previous booklets P31, P32 by the differential portion of the side along transfer direction of booklet. Therefore, in thirty-fifth state (S) when booklet P34 is put on the transfer belt 12, interval d32' between booklet P32 and booklet P34 is same as interval d31 between booklet P31 and booklet P32. In succession, in thirty-seventh state (U) when booklet P35 of same size as booklet P34 is conveyed, transfer amount M1 per booklet on the transfer belt 12 is same as in the case of carry-out of booklet P34. Accordingly, in thirty-eighth state (V) when booklet P35 is put on the transfer belt 12, interval d33' between booklet P34 and booklet P35 is maintained equal to interval of other booklets.

Loading pattern 3 will be described. In loading pattern 3, in thirty-ninth state (W) after thirty-sixth state (T), booklet P36 of same size as booklets P31, P32 is conveyed. At this time, transfer amount per booklet on the transfer belt 12 is same as in the case of carry-out of booklets P31, P32. That is, the size of booklet P36 is larger than the size of booklet P34, and hence transfer amount M1 per booklet is corrected to be larger than transfer amount M2 per booklet in the case of carry-out of booklet P34. Therefore, in fortieth state (X) when booklet P36 is put on the transfer belt 12, interval d33 between booklet P34 and booklet P36 and interval d32' between booklet P32 and booklet P34 are equal to each other.

Thus, in the stacker 10 of the second exemplary embodiment, by the user's instruction of new bookbinding and loading command, if booklets of different sizes are loaded, the control circuit 26 adjusts the transfer amount per booklet on the transfer belt 12. For example, booklets of relatively larger size are conveyed while booklets of relatively smaller size are arrayed on the transfer belt 12, disturbance of vision or loading due to concealing of booklets can be avoided. If booklets of different sizes are loaded in mixture, therefore, visibility of booklets and neatness of loading can be assured.

Third Exemplary Embodiment

A third exemplary embodiment of the invention will be described below.

The third exemplary embodiment of the invention is basically same as in the first exemplary embodiment, except that control contents by the control circuit 26 in FIG. 3 are different, and same constituent elements are identified with same reference numerals, and duplicate explanation is omitted.

In the third exemplary embodiment, the control circuit 26 in FIG. 3 controls the operation of the image-forming device 2, stacker 10, booklet finisher 7, trimmer 8, and square-folding device 9 when booklets of loading amount corresponding to the thickness of booklets are loaded on the loaded tray 13, and stops forming of image on paper, binding of booklets, and loading of booklets on loaded tray 13. By the control circuit 26, stacker 10, and carry-out rollers 11, an example of booklet-loading device of the invention is composed. The control circuit 26 corresponds to an example of stopping unit of the invention.

Figure 15:
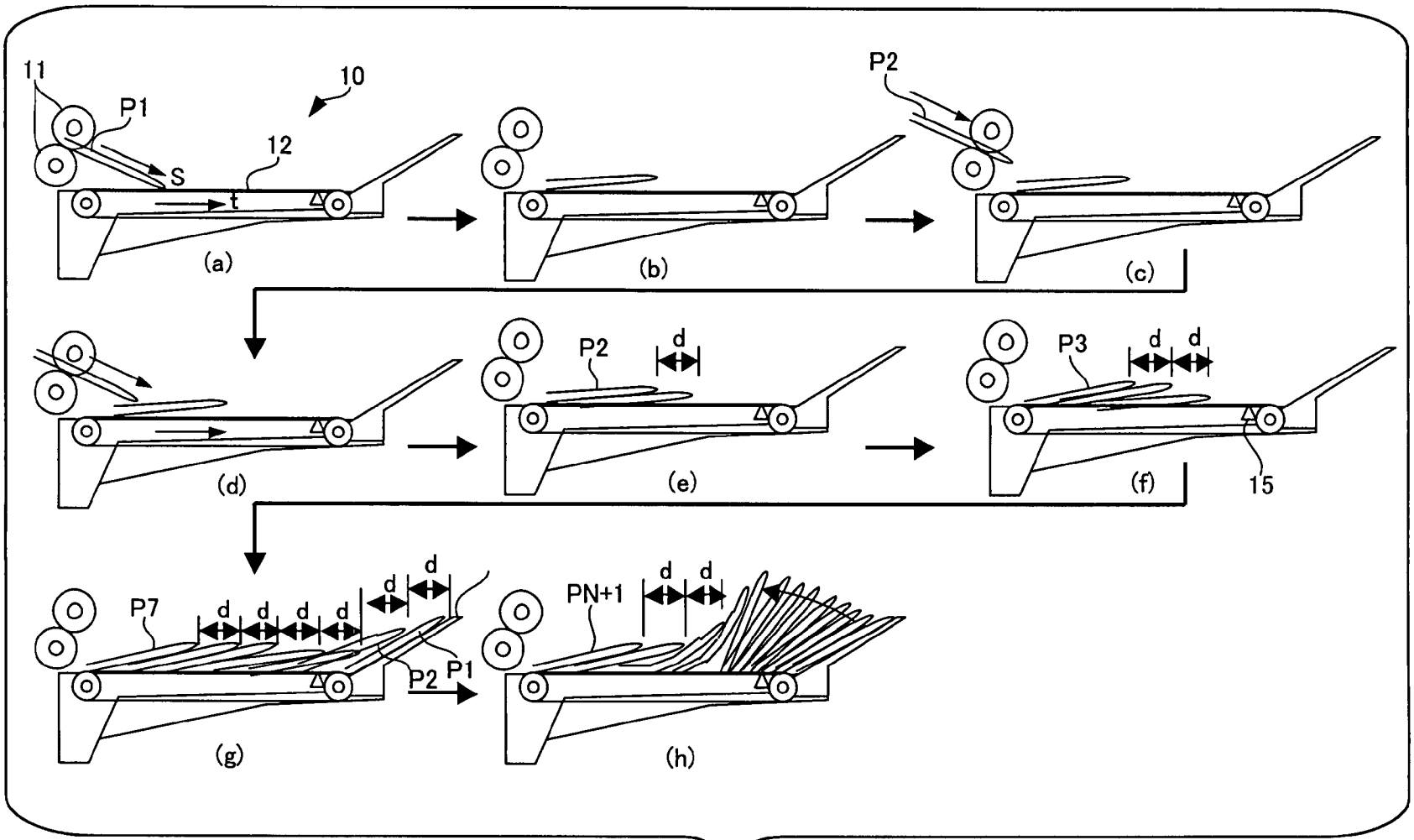
FIG. 15 is a diagram showing loading of booklets on the stacker.

FIG. 15 is a diagram showing how booklets are loaded on the stacker 10.

Specifically, FIG. 15 shows how booklets on the stacker 10 are sequentially loaded from first state (a) to eighth state (h). In first state (a), booklet P1 is conveyed from the carry-out rollers 11 onto the transfer belt 12 in the direction of arrow "s" with the back of booklet forward. The transfer belt 12, synchronizing with the moment of the back of booklet P1 contacting with the transfer belt 12, starts to move in the direction of arrow "t". The transfer belt 12 once stops moving in second state (b) in a short while after booklet P1 is completely separated from the carry-out rollers 11. Booklet P1 is transferred from start till end of move of the transfer belt 12. In third state (c), next booklet P2 is conveyed from the carry-out rollers 11. In fourth state (d), the transfer belt 12, synchronizing with the moment of the back of booklet P2 contacting with the transfer belt 12, starts to move, and once stops moving in fifth state (e) in a short while after booklet P2 is completely separated from the carry-out rollers 11. Thus, the transfer belt 12 moves intermittently, in synchronism with the timing of carry-out of booklet from the carry-out rollers 11. The booklet is conveyed by the move of the transfer belt 12 from the moment of being loaded completely on the transfer belt 12 after being completely separated from the carry-out rollers 11. Here, every time one booklet is conveyed from the carry-out rollers 11, the booklet transfer distance "d" is controlled by the control circuit 26 to be smaller than the length of the side along the moving direction of booklet. Accordingly, the booklets conveyed sequentially from the carry-out rollers 11 are partly overlapped, and arrayed on the transfer belt 12 (fifth state (e)), and the transfer belt 12 transfers the booklets in this state. In sixth state (f), third booklet P3 is put on the transfer belt 12. When further booklets are conveyed, the beginning booklet P1 soon reaches near the leading end of the transfer belt 12, and is detected by the sensor 15. After the booklet P1 is detected by the sensor 15, the number of booklets conveyed from the carry-out rollers 11 is controlled as the loading amount to be loaded on the stacker 10. Afterwards, when more booklets are conveyed in seventh state (g), booklet P1 at the beginning in the transfer direction of the transfer belt 12 rides over the riser part 13*a* of loaded tray 13, and is raised. Next booklet P2 rides over booklet P1 and is raised. Thus, the booklets transferred by the transfer belt 12 are regulated in the move by the loaded tray 13, and are raised. The raised booklets are sequentially loaded as being supported by the preceding booklet and the transfer belt 12. In eighth state (h), booklet PNH of number N+1 is loaded on the transfer belt 12.

Figure 16:
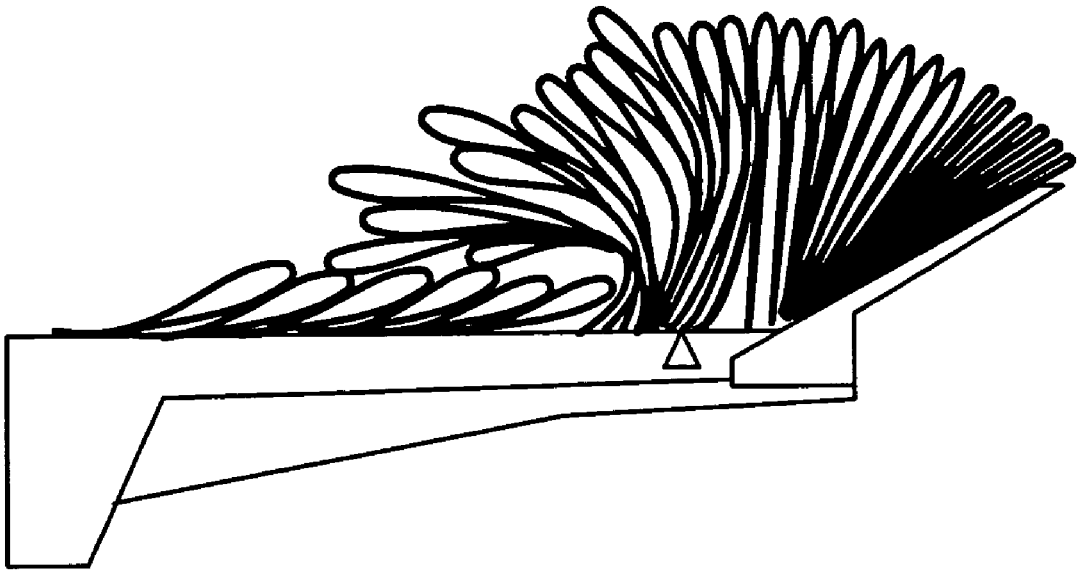
FIG. 16 is a diagram showing collapsing and disturbing of booklets due to excessive loading.

The number of booklets to be loaded on the stacker 10 is limited, and this limit differs with the thickness of booklets. Herein, thickness of booklets is not thickness of loaded booklets when a load is applied from the top, but refers to the thickness of booklets conveyed from the carry-out rollers 11, being free from load, as shown in FIG. 15. Thickness of booklets depends on the thickness of paper for composing booklets, the number of sheets, and the size. For example, if the thickness and number of sheets of paper for composing booklets are the same, thickness of booklets is smaller when the booklet size is larger. As shown in FIG. 14, by the moment of own weight of booklet, a force acts so as not to open the pages. Further, the thickness of booklets depends also on the bookbinding method of booklets. For example, when square folded forming a booklet in a flat back, the thickness of booklet is far smaller than the thickness of booklet without square folding process. Presence or absence of square folding process has an effect, particularly, on the thickness of back portion of booklet. As shown in eighth state (h) in FIG. 15, when booklets of thick back portion without square folding process are loaded, the raising angle of booklets is increased every time next booklet is loaded, and loading continues further, booklets soon collapse in opposite direction to transfer direction. FIG. 16 shows disturbance of array due to collapse of loaded booklets by excessive loading. When the booklet array is disturbed as shown in FIG. 16, it requires extra labor of taking out from the stacker 10 and arraying again. Therefore, the loading amount of booklets is limited within a range not disturbing the array.

Figure 17:
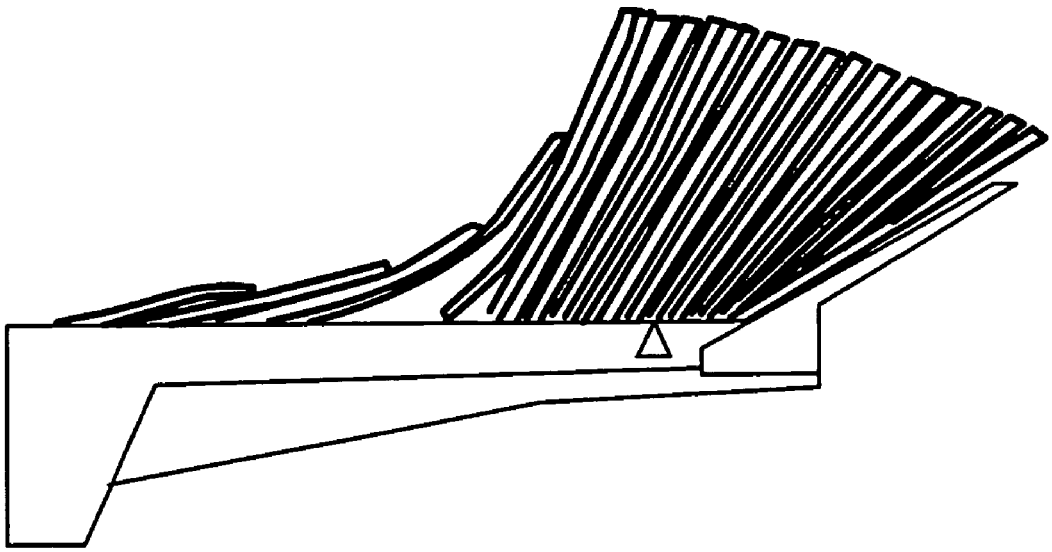
FIG. 17 is a diagram showing loading of booklets with square folding process.

On the other hand, when square folded booklets of small thickness back portion are loaded, if loading continues, the booklet raising angle is hardly changed, and booklets are rarely collapsed if loading continues. FIG. 17 shows loading of square folded booklets. In square folded booklets, loading amount can be increased from booklets without square folding process.

The stacker 10 of the exemplary embodiment loads the booklets by the quantity depending on the thickness of booklets. The loading amount of booklets depending on the thickness of booklets is determined from the table in FIG. 19, on the basis of information of thickness, number of sheets and size of paper for composing booklets, and the information showing presence or absence of square folding process.

Process of determining the loading amount depending on the thickness of booklets, and process of loading the booklets by the determined loading amount will be described, together with the motion of the entire image-forming system 1 while referring also to FIG. 3.

Figure 18:
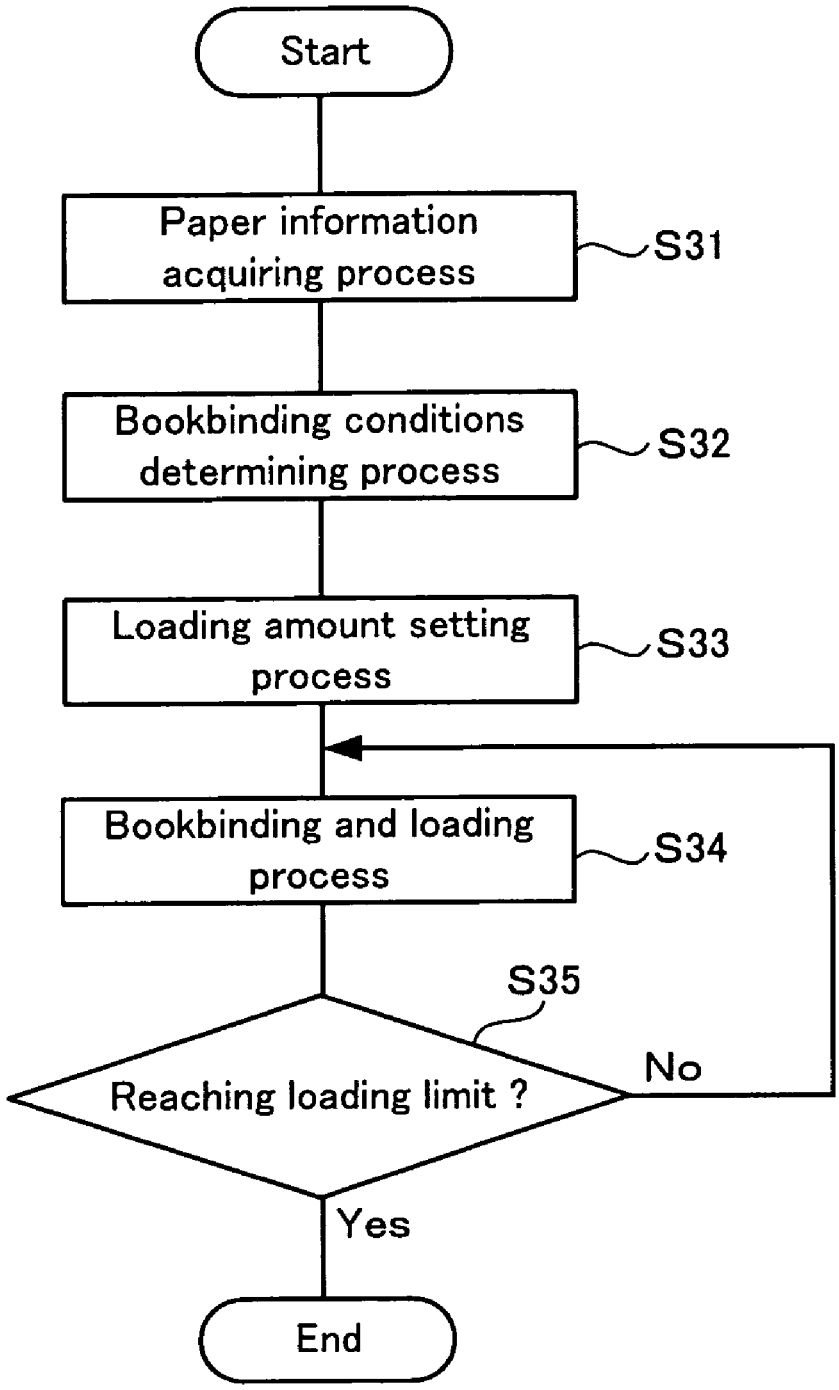
FIG. 18 is a flowchart of image forming and bookbinding process in the image-forming system.

FIG. 18 is a flowchart of image forming and bookbinding process in the image-forming system 1.

When the image forming and bookbinding process is started, first, the control circuit 26 acquires the paper information (step S31). The control circuit 26 displays a message urging input of thickness information on the operation panel 21, about the paper in various sizes stored in paper trays 22 to 25, paper tray 31, and inserter 6. The operation panel 21 also displays a message urging input of size information, about the paper stored in the inserter 6. When the user manipulates the operation panel 21, and enters the information showing the thickness and size, the entered information is supplied in the control circuit 26.

The control circuit 26 sets the bookbinding condition (step S32). The control circuit 26 displays a message on the operation panel 21. This message urges the user to enter information about number of sheet of paper for composing booklets, paper trays to be used, and presence or absence of square folding process for forming booklets in a flat back. When the user manipulates the operation panel 21, and enters the information about number of sheets, paper size, and presence or absence of square folding process, the entered information is supplied in the control circuit 26. Thus, the control circuit 26 acquires information about thickness, number of sheets, paper size of the paper for composing booklets, and presence or absence of square folding process. From the selected information about paper size, the tray for storing the paper of corresponding size is selected.

In consequence, the control circuit 26 performs the process which determines the loading amount to be loaded on the stacker 10 (step S33). The control circuit 26 applies the information obtained at steps S31 and S32, that is, the information showing the thickness, number of sheets and size of paper for composing booklets, and information showing presence or absence of square folding process for forming booklets in a flat back, in the table in FIG. 19, and determines the corresponding loading amount. The determined loading amount is set as the loading limit.

FIG. 19 is an example of table showing the relation of thickness, number of sheets and size of paper for composing booklets, presence or absence of square folding process for forming booklets in a flat back, and loading amount. This table is stored in the ROM of control circuit 26. In three rows from the left end of the table, paper size, thickness of sheets except for title page, and number of sheets are expressed sequentially from the left. In the top two lines of the table, presence or absence of square folding process, and thickness of title page are expressed from the top. According to these conditions, the table expresses the number of booklets to be loaded according to the thickness of booklets. For example, in the case of paper size of A4, paper thickness of 80 g/m$^2$, number of sheets of 5 without title page, and absence of square folding process, the loading amount is limited to 20 booklets. On the other hand, in the same conditions, with presence of square folding process, the loading amount is 160 booklets. Thus, the loading amount is determined in an appropriate quantity depending on the thickness of booklets, not determined uniformly on the basis of booklets likely to be disturbed. Therefore, the loading amount of booklets can be increased according to the type of booklets. The loading amount depending on the thickness of booklets can be determined indirectly on the basis of the paper thickness, number of sheets, size, and presence or absence of square folding process for forming booklets in a flat back. In addition, "Prohibited" item in the table means that booklets cannot be loaded properly in the corresponding conditions in the column. The control circuit 26 preliminarily reads out the table shown in FIG. 19 at step S32. If the user enters information of prohibited condition at step S32, the control circuit 26 shows a message urging to enter information in other condition on the operation panel 21.

Back to FIG. 18, explanation continues.

At step S34, the control circuit 26 executes the bookbinding and loading process. The control circuit 26, on the basis of the information obtained at steps S31, S32, controls the operation of the image-forming device 2, booklet finisher 7, trimmer 8, and square-folding device 9, and forms images on paper and binds one booklet. The control circuit 26 moves the transfer belt 12 of the stacker 10 at the timing of carry-out of booklet to the carry-out rollers 11 of the square-folding device 9. As a result, the booklet conveyed from the carry-out rollers 11 is conveyed by the transfer belt 12. The control circuit 26 adds 1 to the booklet count showing the number of booklets every time a booklet is conveyed from the carry-out rollers 11. While the sensor 15 of the stacker 10 is not detecting booklets, booklets are not at the leading end of the transfer belt 12 yet, or it is judged that loaded booklets are removed by the user, and the booklet count is cleared to zero. That is, the booklet count shows the number of booklets loaded on the stacker 10 after booklets reach near the leading end of the transfer belt 12.

The control circuit 26 judges if the value of booklet count has reached the loading limited determined (step S35). If not reaching the loading limit (No at step S35), the control circuit 26 repeats the process from step S34. When reaching the loading limit (Yes at step S35), the control circuit 26 terminates the process shown in FIG. 18. At this moment, the booklets by the loading amount corresponding to the thickness of booklets are loaded on the loaded tray 13.

Thus, according to the exemplary embodiment, since the booklets by the loading amount corresponding to the thickness of booklets are loaded on the stacker 10, the booklets can be loaded to a maximum extent, depending on the type of booklets, so as not to overflow or disturb the neat array. Therefore, by making use of the loading space, multiple booklets can be loaded. Besides, since the control circuit 26 determines the loading amount on the basis of the information showing at least one of thickness, number of sheets and size, and the information showing presence or absence of square folding process, if the thickness of booklets is not known directly, appropriate loading amount of booklets can be determined depending on the type of booklets on the basis of known information.

In the exemplary embodiment, the control circuit 26 is assembled in the image-forming device 2, but not limited to this case, for example, the control circuit may be mounted on the stacker.

In the exemplary embodiment, the carry-out rollers 11 are assembled in the square-folding device 9, but, for example, the carry-out roller may be assembled in the stacker.

In the exemplary embodiment, about the paper for composing booklets, information showing the thickness, number of sheet and size, and information showing presence or absence of square folding process are obtained, and thickness of booklets is determined on the basis of obtained information, but the invention is not limited to this example, and thickness of booklets may be measured by using a thickness sensor or the like.

In the exemplary embodiment, the transfer belt 12 is moved intermittently in synchronism with transfer of booklets, but the invention is not limited to this example alone, and it is enough when the moving distance is controlled every time one booklet is conveyed from the carry-out unit, and the transfer belt 12 is not limited to intermittent move, may be also moved continuously.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A booklet-loading device comprising:

a carry-out unit that conveys a plurality of booklets sequentially;

a transfer unit that transfers the plurality of booklets sequentially conveyed from the carry-out unit, and arranges the plurality of booklets in a partly overlapped state;

a loaded unit that is loaded with the booklets transferred by the transfer unit; and a transfer control unit that controls a transfer amount per booklet in the transfer unit to a transfer amount depending on a quantity of booklets loaded on the loaded unit, wherein the transfer unit performs intermittent transfer of the booklets in which movement of the booklets for set time and stop of the booklets are repeated in synchronism with the conveyance of the booklet from the carry-out unit to the transfer unit, the set time being represented by the transfer amount controlled by the transfer control unit, wherein the booklet-loading device is connected to a bookbinding device that binds booklets according to specified bookbinding conditions showing at least one of thickness, number, size of paper composing the booklets, and presence or absence of square folding process to form the booklets in a flat back, and the booklet-loading device further comprises a sensor which detects arrival of the first booklet of the plurality of booklet near the loaded unit by being transferred by the transfer unit, and wherein the transfer control unit determines a reference transfer amount on the basis of the bookbinding conditions specified in the bookbinding device, and controls the transfer amount per booklet in the transfer unit (a) to a transfer amount which is larger than the reference transfer amount before the sensor detects the arrival of the first booklet, (b) to a transfer amount which is the same as the reference transfer amount after the sensor detects the arrival of the first booklet and before the quantity of booklets loaded on the loaded unit reaches a predetermined high density loading standard, (c) to a transfer amount which is smaller than the reference transfer amount after the sensor detects the arrival of the first booklet and after the quantity of booklets loaded on the loaded unit reaches the predetermined high density loading standard.

2. The booklet-loading device according to claim 1, wherein the loaded unit raises the booklets by regulating the move of booklets transferred by the transfer unit, and is loaded with the raised booklets.

* * * * *